US009423710B2

(12) United States Patent
Magome et al.

(10) Patent No.: US 9,423,710 B2
(45) Date of Patent: Aug. 23, 2016

(54) MAGNETIC TONER

(71) Applicant: CANON KABUSHIKI KAISHA, Tokyo (JP)

(72) Inventors: Michihisa Magome, Mishima (JP); Tadashi Dojo, Numazu (JP); Yusuke Hasegawa, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 19 days.

(21) Appl. No.: 14/364,068

(22) PCT Filed: Dec. 26, 2012

(86) PCT No.: PCT/JP2012/084291
§ 371 (c)(1),
(2) Date: Jun. 9, 2014

(87) PCT Pub. No.: WO2013/100187
PCT Pub. Date: Jul. 4, 2013

(65) Prior Publication Data

US 2014/0315126 A1 Oct. 23, 2014

(30) Foreign Application Priority Data

Dec. 27, 2011 (JP) ..... 2011-286202

(51) Int. Cl.
*G03G 9/097* (2006.01)
*G03G 9/083* (2006.01)
*G03G 9/08* (2006.01)

(52) U.S. Cl.
CPC ..... *G03G 9/0833* (2013.01); *G03G 9/0825* (2013.01); *G03G 9/0835* (2013.01); *G03G 9/0839* (2013.01); *G03G 9/09708* (2013.01); *G03G 9/09725* (2013.01)

(58) Field of Classification Search
CPC ... G03G 9/0825; G03G 8/33; G03G 9/09725; G03G 9/0835; G03G 9/09708; G03G 9/0839
See application file for complete search history.

(56) References Cited

U.S. PATENT DOCUMENTS 5,066,558 A 11/1991 Hikake et al.
6,485,876 B1 11/2002 Takezawa et al.
(Continued)

FOREIGN PATENT DOCUMENTS

JP 57-93352 A 6/1982
JP 63-074070 * 4/1988 ..... G03G 9/08
(Continued)

OTHER PUBLICATIONS

Translation of JP 08-012478 published Jan. 1996.*
(Continued)

*Primary Examiner* — Peter Vajda
(74) *Attorney, Agent, or Firm* — Fitzpatrick, Cella, Harper & Scinto

(57) ABSTRACT

The magnetic toner includes magnetic toner particles comprising a binder resin and a magnetic body and inorganic fine particles present on the surface of the magnetic toner particles, wherein the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particle's surface by the inorganic fine particles and a coverage ratio B (%) is a coverage ratio of the magnetic toner particle' surface by the inorganic fine particles that are fixed to the magnetic toner particle's surface, the magnetic toner has a coverage ratio A, a coefficient of variation on the coverage ratio A, a ratio of the coverage ratio B to the coverage ratio A, and a compression ratio in a specific range.

4 Claims, 9 Drawing Sheets

(56) References Cited

U.S. PATENT DOCUMENTS

| | | | |
|---|---|---|---|
| 6,524,762 | B2 | 2/2003 | Tsutsui et al. |
| 7,537,877 | B2 | 5/2009 | Yoshiba et al. |
| 7,740,998 | B2 | 6/2010 | Yamazaki et al. |
| 7,939,231 | B2 | 5/2011 | Ogawa et al. |
| 8,007,978 | B2 | 8/2011 | Klier et al. |

FOREIGN PATENT DOCUMENTS

| | | | | | |
|---|---|---|---|---|---|
| JP | 63-74070 | A | | 4/1988 | |
| JP | 2-167561 | A | | 6/1990 | |
| JP | 4-145448 | A | | 5/1992 | |
| JP | 6-250546 | | * | 9/1994 | ..... G03G 15/20 |
| JP | 6-250546 | A | | 9/1994 | |
| JP | 02-167561 | | * | 1/1996 | ..... C05G 1/00 |
| JP | 08-012478 | | * | 1/1996 | ..... C05G 1/00 |
| JP | 10-48869 | A | | 2/1998 | |
| JP | 2001-117267 | A | | 4/2001 | |
| JP | 2001-356516 | A | | 12/2001 | |
| JP | 2003-43738 | A | | 2/2003 | |
| JP | 2005-091488 | | * | 4/2005 | ..... G03G 9/083 |
| JP | 2005-91488 | A | | 4/2005 | |
| JP | 3812890 | B2 | | 8/2006 | |
| JP | 2006-323326 | | * | 11/2006 | ..... G03G 9/083 |
| JP | 2006-323326 | A | | 11/2006 | |
| JP | 2007-86634 | A | | 4/2007 | |
| JP | 2007-293043 | A | | 11/2007 | |
| JP | 2008-15248 | A | | 1/2008 | |
| JP | 2010-79312 | A | | 4/2010 | |
| RU | 2386158 | C1 | | 4/2010 | |
| RU | 2397525 | C2 | | 8/2010 | |

OTHER PUBLICATIONS

Translation of JP 2006-323326 published Nov. 2006.*
Translation of JP 2005-091488 published Apr. 2005.*
Hasegawa, et al., U.S. Appl. No. 14/364,067, filed Jun. 9, 2014.
Ohmori, et al. U.S. Appl. No. 14/364,633, filed Jun. 11, 2014.
Hiroko, et al., U.S. Appl. No. 14/364,065, filed Jun. 9, 2014.
Suzumura, et al., U.S. Appl. No. 14/362,380, filed Jun. 2, 2014.
Matsui, et al., U.S. Appl. No. 14/362,377, filed Jun. 2, 2014.
Sang, et al., U.S. Appl. No. 14/364,636, filed Jun. 11, 2014.
Uratani, et al., U.S. Appl. No. 14/364,634, filed Jun. 11, 2014.
Nomura, et al., U.S. Appl. No. 14/364,640, filed Jun. 11, 2014.
Tanaka, et al., U.S. Appl. No. 14/364,638, filed Jun. 11, 2014.
PCT International Search Report and Written Opinion of the International Searching Authority, International Application No. JP2012/084291, Mailing Date Mar. 12, 2013.
Japanese Office Action dated May 12, 2015 in Japanese Application No. 2011-286202.
Korean Office Action dated May 21, 2015 in Korean Application No. 10-2014-7020107.
Russian Office Action dated May 25, 2015 in Russian Application No. 2014130783.

* cited by examiner

MAGNETIC TONER

TECHNICAL FIELD

The present invention relates to a magnetic toner for use in recording methods that use, for example, electrophotographic methods.

BACKGROUND ART

Numerous methods are known for the execution of electrophotography. At a general level, using a photoconductive material an electrostatic latent image is formed on an electrostatic image-bearing member (also referred to as a "photosensitive member" below) by various means. Then, a visible image is made by developing this latent image with toner; as necessary the toner image is transferred to a recording medium such as paper; and a copied article is obtained by fixing the toner image on the recording medium by, for example, the application of heat or pressure. For example, copiers and printers are image-forming apparatuses that use such an electrophotographic procedure.

These printers and copiers have in recent years been transitioning from analog to digital, and while there is strong demand for an excellent latent image reproducibility and high resolution, there is at the same time strong demand for size reduction, particularly with printers.

Previously, printers were connected in networks and such printers were often tasked with printing from a large number of people; however, in the last few years there has also been substantial demand for local printing in which the PC and printer are located on the individual's desktop. This has made it necessary to reduce the space taken up by printers and there is strong demand for printer downsizing.

Here, when printer downsizing is closely considered, it may be understood that mainly reducing the size of the fixing unit and reducing the size of the developing device (cartridge) will be effective for achieving size reduction. In particular, the latter accounts for a considerable portion of the volume of a printer, and it can thus be concluded that reducing the size of the developing device is essential for reducing printer size.

When the developing system is considered in this context, two-component development systems and monocomponent development systems are available as the printer development system; however, magnetic monocomponent development systems are best for size reduction. This is because they do not use components such as a carrier or a toner-coating roller.

Reducing the diameter of the electrostatic latent image-bearing member and the diameter of the toner-carrying member are effective when size reduction is considered in the case of magnetic monocomponent development systems; however, problems are also caused by reducing these diameters.

One of these problems is a phenomenon, known as "ghosting", in which density irregularities appear in the image. A brief description of "ghosting" is provided in the following.

Development proceeds through the transfer of toner carried by the toner-carrying member to the electrostatic latent image. During this time, fresh toner is supplied to the regions where the toner on the surface of the toner-carrying member has been consumed (regions corresponding to image areas), while unconsumed toner remains present as such in regions where there has been no toner consumption (regions corresponding to nonimage areas). As a result, a difference in the amount of charging is produced between the freshly supplied toner (hereafter referred to as the supplied toner) and the toner that has remained present (hereafter referred to as the residual toner). Specifically, the freshly supplied toner has a relatively lower amount of charge and the toner that has remained present has a relatively higher amount of charge. Ghosting is produced due to this difference (refer to FIG. 1).

This difference in the amount of charging between the residual toner and the supplied toner is caused by the fact that the number of times the residual toner is subjected to charging grows to large values, in contrast to the fact that the supplied toner is subjected to charging, i.e., is passed through the contact region between the regulating blade and the toner-carrying member (referred to below as the contact region), a single time.

Furthermore, a small-diameter toner-carrying member means that the toner-carrying member will have a large curvature, resulting in a decline in the area of the contact region between the regulating blade and the toner-carrying member and a slow rise in toner charge. This causes a larger difference in the amount of charge between the supplied toner and the residual toner and a worsening of ghosting.

There have attempts to improve the preceding by controlling the flowability of the toner. These include, for example, adjusting the degree of agglomeration (Patent Document 1) and controlling the compression ratio of the toner (Patent Document 2). However, the effects are inadequate when the toner-carrying member has a small diameter due, as described above, to the small area of the contact region with the regulating blade. In addition, because the regulating blade generally has the opposite charging performance from the toner, the toner ends up sticking to the regulating blade and a uniform charge cannot be obtained. The improvement in ghosting is unsatisfactory as a result and additional improvements have been required.

On the other hand, in order to solve the problems associated with external additives, toners have been disclosed with a particular focus on the release of external additives (refer to, for example, Patent Documents 3 and 4). The charging performance of toners is again not adequately addressed in these cases.

Moreover, Patent Document 5 teaches stabilization of the development transfer steps by controlling the total coverage ratio of the toner base particles by the external additives, and a certain effect is in fact obtained by controlling the theoretical coverage ratio, provided by calculation, for a certain prescribed toner base particle. However, the actual state of binding by external additives is substantially different from the value calculated assuming the toner to be a sphere and such a theoretical coverage ratio does not correlate with the ghosting problem described above and improvement has been necessary.

CITATION LIST

Patent Literature

[PTL 1] Japanese Patent Application Publication No. 2003-43738

[PTL 2] Japanese Patent Application Publication No. 2001-356516

[PTL 3] Japanese Patent Application Publication No. 2001-117267

[PTL 4] Japanese Patent Publication No. 3,812,890

[PTL 5] Japanese Patent Application Publication No. 2007-293043

SUMMARY OF INVENTION

Technical Problems

The present invention was pursued in view of the problems described above with the prior art and has as an object of providing a toner capable of yielding an image that has a high image density and is free of ghosting.

Solution to Problem

Thus, the present invention is a magnetic toner comprising magnetic toner particles comprising a binder resin and a magnetic body, and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has:

i) a coverage ratio A of at least 45.0% and not more than 70.0% and a coefficient of variation on the coverage ratio A of less than 10.0%, ii) a ratio [coverage ratio B/coverage ratio A] of the coverage ratio B to the coverage ratio A of from at least 0.50 to not more than 0.85, and iii) a compression ratio obtained by the following formula (1) of from at least 38% to not more than 42%:

$$\text{compression ratio}(\%)=\{1-(\text{bulk density}/\text{packed bulk density})\}\times 100. \quad \text{formula (1):}$$

Advantageous Effects of Invention

The present invention can provide a toner that can yield an image that has a high image density and is free of ghosting.

DESCRIPTION OF EMBODIMENTS

Figure 1:
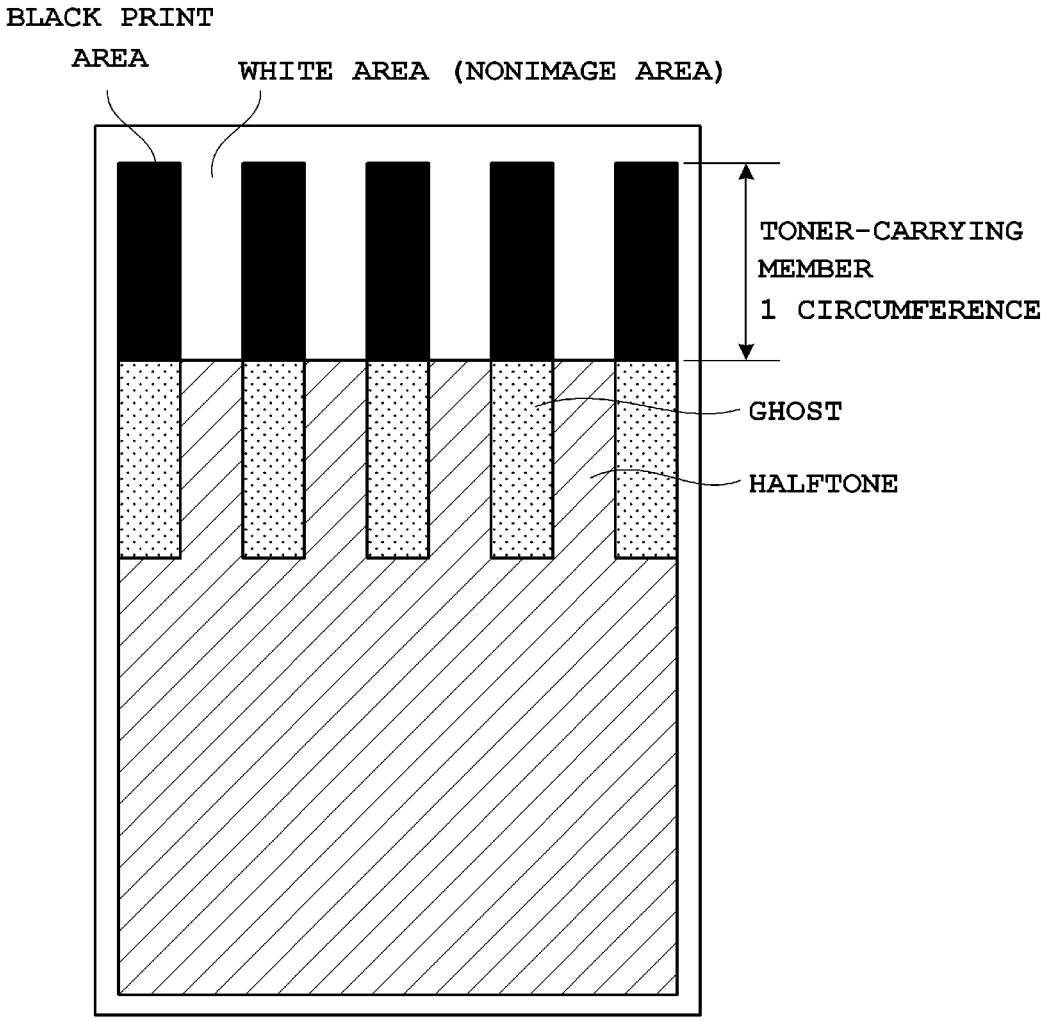
FIG. 1 is a conceptual diagram of ghosting.

The present invention is described in detail below.

The present invention relates to a magnetic toner comprising magnetic toner particles comprising a binder resin and a magnetic body and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particle surface, the magnetic toner has:

i) a coverage ratio A of at least 45.0% and not more than 70.0% and a coefficient of variation on the coverage ratio A of less than 10.0%, ii) a ratio [coverage ratio B/coverage ratio A] of the coverage ratio B to the coverage ratio A of from at least 0.50 to not more than 0.85, and iii) a compression ratio obtained by the following formula (1) of from at least 38% to not more than 42%:

$$\text{compression ratio}(\%)=\{1-(\text{bulk density}/\text{packed bulk density})\}\times 100. \quad \text{formula (1):}$$

Figure 2:
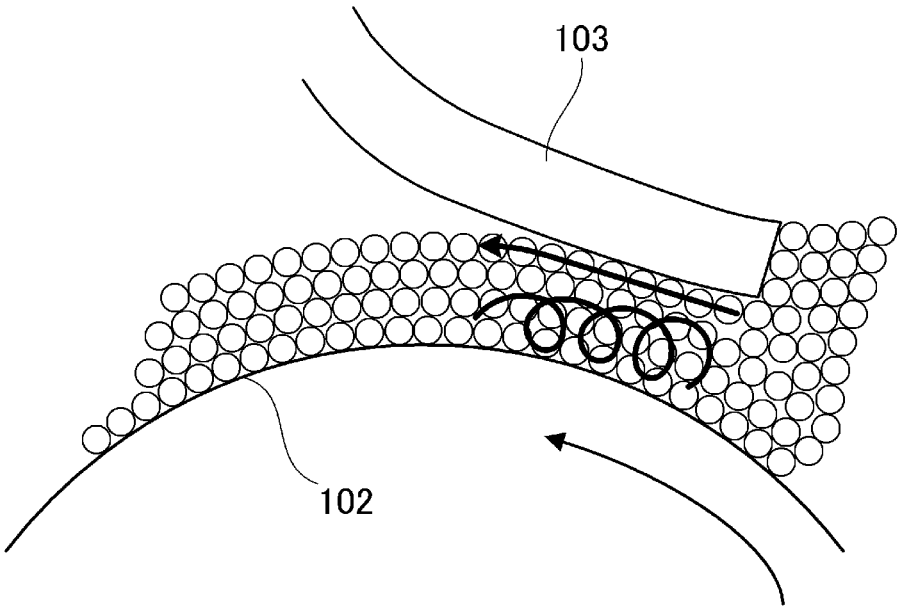
FIG. 2 is a schematic diagram of toner behavior in the contact region between the regulating blade and the toner-carrying member.

First, a schematic diagram of the behavior of magnetic toner in the contact region is shown in FIG. 2. The magnetic toner is transported by the toner-carrying member 102 and in the contact region the magnetic toner is subjected to a force due to transport by the toner-carrying member and to a force due to the pressure from the regulating blade 103. Due to the effect of unevenness on the surface of the toner-carrying member, the magnetic toner is transported while being turned over and undergoes agitation. Due to this turn over of the magnetic toner in the contact region, the magnetic toner comes into contact with the regulating blade or toner-carrying member and is subjected to rubbing. The magnetic toner is charged by this and then bears an electric charge.

However, the magnetic toner that is in proximity to the regulating blade, because it is relatively distant from the unevenness on the surface of the toner-carrying member, is less subject to the effects therefrom and is less prone to undergo turn over. Due to this, the magnetic toner in proximity to the regulating blade tends to simply undergo transport as such.

Furthermore, the regulating blade generally has the opposite charging performance from that of the magnetic toner due to triboelectric charging of the magnetic toner and an electrostatic force then acts between the magnetic toner and the regulating blade, and it is thought that the magnetic toner in proximity to the regulating blade is in a state resistant to jostling.

In particular, a larger electrostatic force is produced between the magnetic toner and the regulating blade when rapid charging of the magnetic toner is to be carried out. As a result, the magnetic toner will more readily stick to the regulating blade and turn over of the magnetic toner in proximity to the regulating blade is then inhibited.

Charging of the magnetic toner is readily impeded in this state and magnetic toner having a low amount of charge also appears and an improvement in ghosting is impaired.

Due to this, when an excellent turn over by the magnetic toner in the contact region occurs, much of the magnetic toner can then be brought into contact with the regulating blade during passage through the contact region. Furthermore, it is thought that a very good triboelectric charging is produced by the free rotation of the magnetic toner that has contacted the regulating blade or toner-carrying member and that as a result an excellent initial rise in magnetic toner charge is obtained and ghosting is reduced.

Here, the forces produced between the magnetic toner and the regulating blade must be considered when one considers the sticking to the regulating blade that impedes turn over of the magnetic toner in the contact region. The following can be considered for these forces: [1] a nonelectrostatic force, i.e., van der Waals force, and [2] an electrostatic force (electrostatic adhesion force), i.e., a reflection force.

Considering first the [1] van der Waals force, the van der Waals force (F) produced between a flat plate and a particle is shown by the following formula.

$$F=H\times D/12Z^2$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is estimated to be smaller for an inorganic fine particle, with its smaller particle size, in contact with the flat plate than for a magnetic toner particle in contact with the flat plate. That is, when considering the van der Waals force, the van der Waals force with the magnetic toner is considered to be smaller for contact across the inorganic fine particles functioning as an external additive than for direct contact by the magnetic toner particles with the regulating blade.

Furthermore, while there is an electrostatic adhesion force, the electrostatic adhesion force can also be regarded as a reflection force. It is known that a reflection force is directly proportional to the square of the particle charge (q) and is inversely proportional to the square of the distance.

When the charging of a magnetic toner is considered, it is thought that the surface of the magnetic toner particle bears the charge and not the inorganic fine particles. Due to this, the reflection force is thought to decline as the distance between the surface of the magnetic toner particle and the flat plate (here, the regulating blade) grows larger.

Here, when focusing again on the magnetic toner surface, it is thought that the reflection force declines due to the distance set up between the magnetic toner particle surface and the flat plate when the magnetic toner particle comes into contact with the flat plate through the intermediary of the inorganic fine particles.

As previously described, the van der Waals force and reflection force produced between the magnetic toner and the regulating blade are reduced, that is, the attachment force between the magnetic toner and the regulating blade is reduced, by having inorganic fine particles be present on the magnetic toner particle surface and having the magnetic toner come into contact with the regulating blade with the inorganic fine particles interposed therebetween.

Whether the magnetic toner particle directly contacts the regulating blade or is in contact therewith through the intermediary of the inorganic fine particles, depends on the amount of inorganic fine particles coating the magnetic toner particle surface, i.e., on the coverage ratio by the inorganic fine particles. As a consequence, the coverage ratio by the inorganic fine particles of the magnetic toner particle surface must be considered. It is thought that the opportunity for direct contact between the magnetic toner particles and the regulating blade is diminished at a high coverage ratio by the inorganic fine particles, which makes it more difficult for the magnetic toner to stick to the regulating blade. On the other hand, the magnetic toner readily sticks to the regulating blade at a low coverage ratio by the inorganic fine particles and turn over of the magnetic toner in the contact region is then impeded.

With regard to the coverage ratio by the inorganic fine particles as an external additive, a theoretical coverage ratio can be calculated—making the assumption that the inorganic fine particles and the magnetic toner have a spherical shape—using the equation described, for example, in Patent Document 5. However, there are also many instances in which the inorganic fine particles and/or the magnetic toner do not have a spherical shape, and in addition the inorganic fine particles may also be present in an aggregated state at the magnetic toner particle surface. As a consequence, the theoretical coverage ratio derived using the indicated technique does not pertain to ghosting.

The present inventors therefore carried out observation of the magnetic toner surface with the scanning electron microscope (SEM) and determined the coverage ratio for the actual coverage of the magnetic toner particle surface by the inorganic fine particles.

Figure 3:
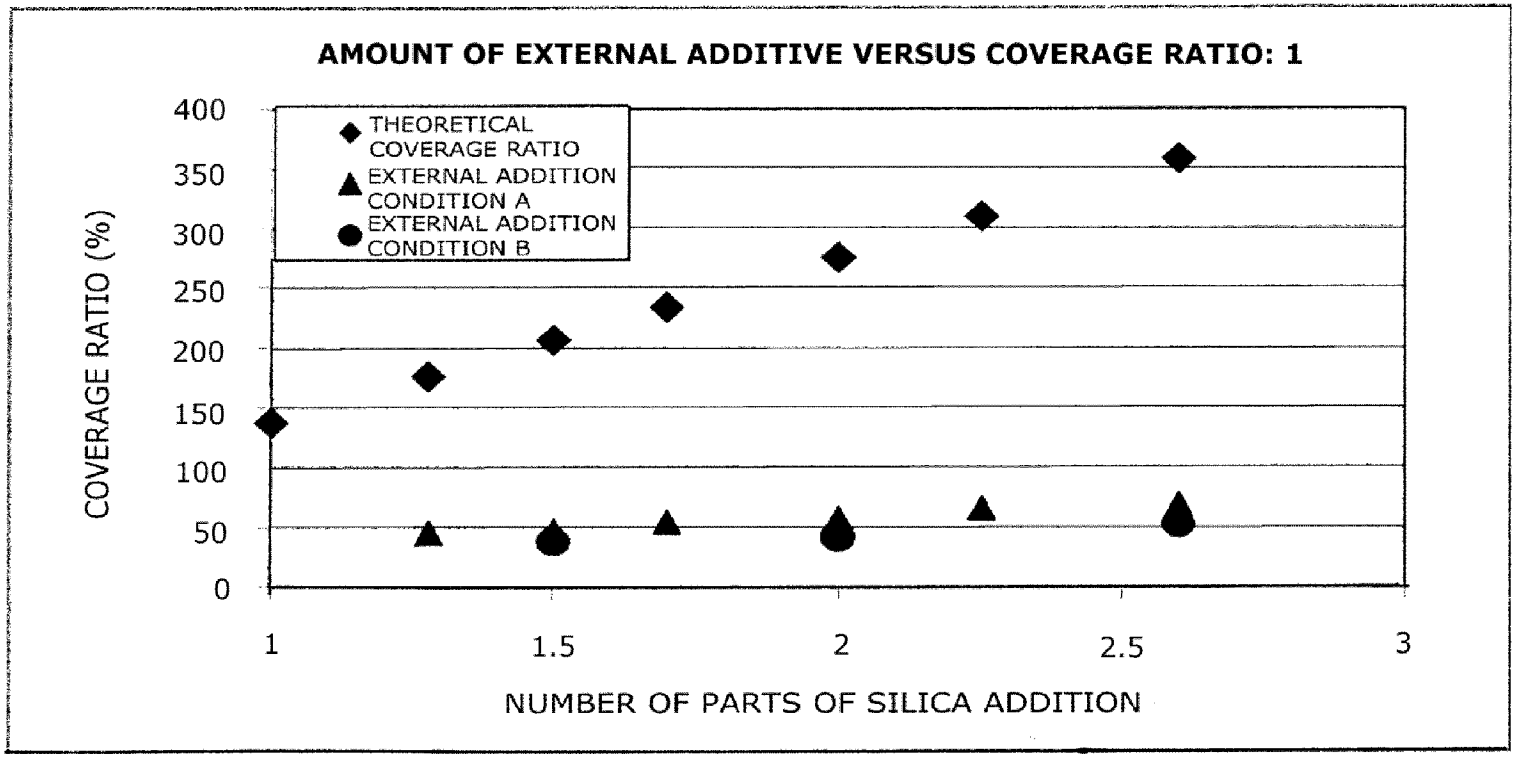
FIG. 3 is a diagram that shows the relationship between the amount of external additive and the external additive coverage ratio.
Figure 4:
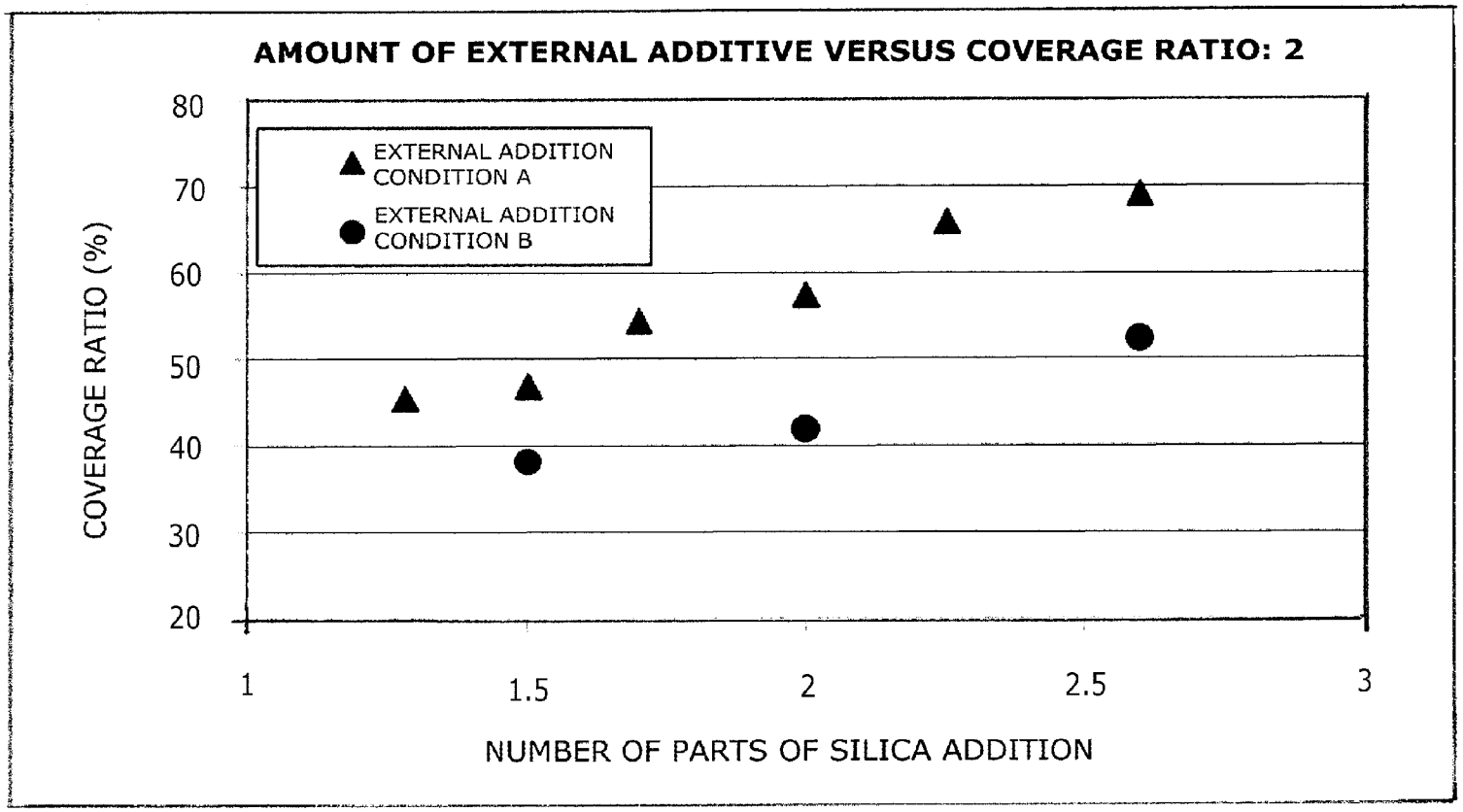
FIG. 4 is a diagram that shows the relationship between the amount of external additive and the external additive coverage ratio.

As one example, the theoretical coverage ratio and the actual coverage ratio were determined for mixtures prepared by adding different amounts of silica fine particles (number of parts of silica addition to 100 mass parts of magnetic toner particles) to the magnetic toner particles (magnetic body content being 43.5 mass %) by a pulverization method, with a volume-average particle diameter (Dv) being 8.0 μm (refer to FIGS. 3 and 4). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 3, the theoretical coverage ratio exceeds 100% as the amount of addition of the silica fine particles is increased. On the other hand, the coverage ratio obtained by actual observation does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique (refer to FIG. 4). That is, it is not possible to determine the coverage ratio uniquely from the amount of addition of the inorganic fine particles. Here, external addition condition A refers to mixing at 1.0 W/g for a processing time of 5 minutes using the apparatus shown in FIG. 6. External addition condition B refers to mixing at 4000 rpm for a processing time of 2 minutes using an FM10C Henschel mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

In addition, as has been noted above, it is thought that the attachment force to a member can be reduced by raising the coverage ratio by the inorganic fine particles. Tests were therefore carried out on the attachment force with a member and the coverage ratio by the inorganic fine particles.

Here, the relationship between the coverage ratio for the magnetic toner and the attachment force with a member was indirectly inferred by measuring the static friction coefficient between an aluminum substrate and spherical polystyrene particles having different coverage ratios by silica fine particles.

Specifically, the relationship between the coverage ratio and the static friction coefficient was determined using spherical polystyrene particles (weight-average particle diameter (D4)=7.5 μm) that had different coverage ratios (coverage ratio determined by SEM observation of the magnetic toner surface) by silica fine particles.

Figure 5:
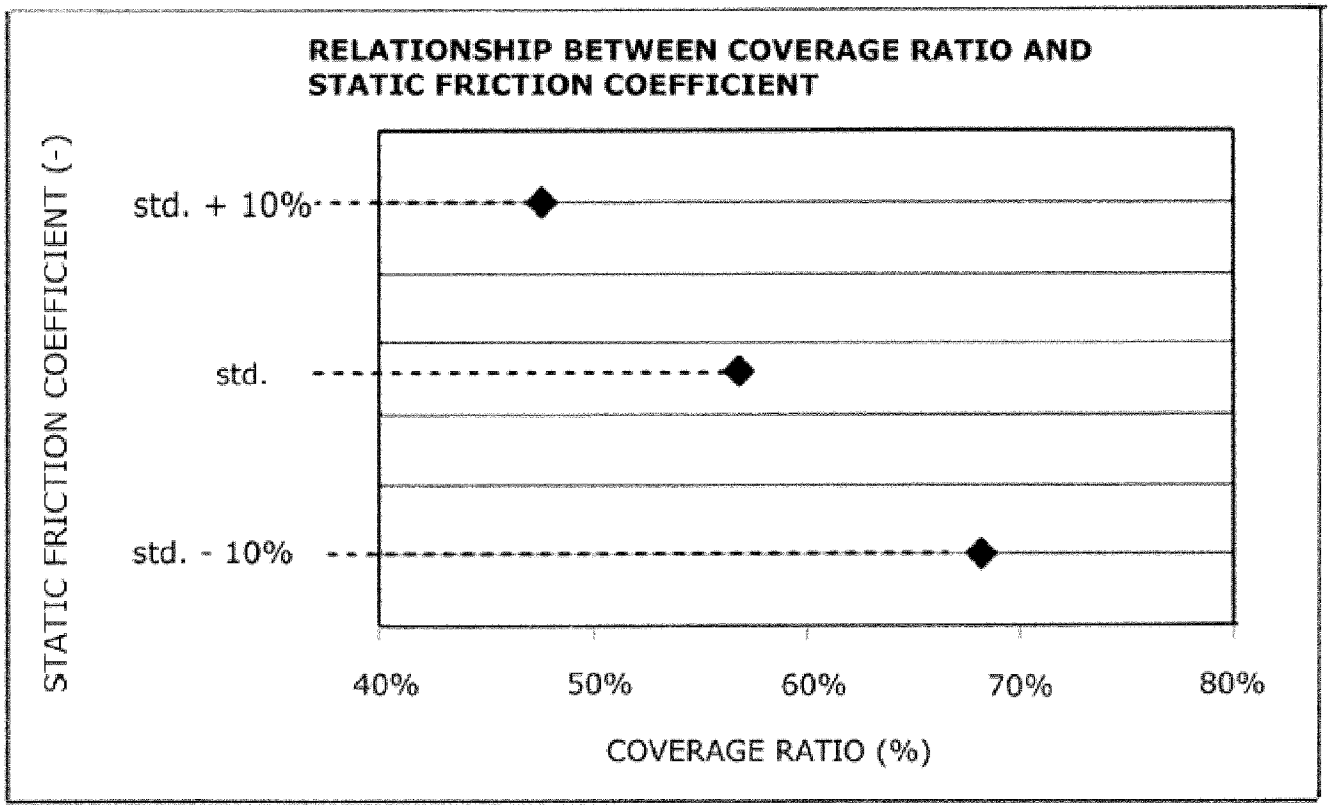
FIG. 5 is a diagram that shows the relationship between the coverage ratio and the static friction coefficient.

More specifically, spherical polystyrene particles to which silica fine particles had been added were pressed onto an aluminum substrate. The substrate was moved to the left and right while changing the pressing pressure, and the static friction coefficient was calculated from the resulting stress. This was performed for the spherical polystyrene particles at each different coverage ratio, and the obtained relationship between the coverage ratio and the static friction coefficient is shown in FIG. 5.

The static friction coefficient determined by the preceding technique is thought to correlate with the sum of the van der Waals and reflection forces acting between the spherical polystyrene particles and the substrate. According to FIG. 5, it is understood that a trend appears in which the static friction coefficient declines as the coverage ratio by the silica fine particles increases. That is, it is inferred that a magnetic toner having a high coverage rate by inorganic fine particles also has a low attachment force for a member.

When the present inventors carried out extensive investigations based on the preceding results, ghosting could be substantially reduced by having the coverage ratio A be at least 45.0% and not more than 70.0%, the coefficient of variation on the coverage ratio A be less than 10.0%, and the ratio [B/A] of the coverage ratio B to the coverage ratio A be at least 0.50 and not more than 0.85, wherein the coverage ratio A (%) is the coverage ratio of the magnetic toner particle surface by the inorganic fine particles and the coverage ratio B (%) is the coverage ratio by the inorganic fine particles that are fixed to the magnetic toner particle surface; by having the inorganic fine particles present on the surface of the magnetic toner particles contain at least one type of metal oxide fine particle selected from the group consisting of silica fine particles, titania fine particles, and alumina fine particles, and having at least 85 mass % of the metal oxide fine particles be silica fine particles; and by having the compression ratio of the magnetic toner be from at least 38% to not more than 42%. The reasons for this are as follows.

First, with regard to the coverage ratio A, the attachment force to a member declines as the coverage ratio increases as described above. Due to this, when the coverage ratio A is at least 45%, it is thought that the attachment force to the regulating blade is diminished and sticking is then inhibited. On the other hand, the inorganic fine particles must be added in large amounts in order to bring the coverage ratio A above 70.0%, and, even if an external addition method could be devised here, image defects, for example, vertical streaks, brought about by released inorganic fine particles are then produced and this is therefore disfavored. In addition, when the coverage ratio A is less than 45.0%, a large attachment force then occurs between the magnetic toner and the regulating blade and the turn over of the magnetic toner becomes inadequate and ghosting cannot be reduced.

The coverage ratio A is more preferably from at least 45.0% to not more than 65.0%.

It is critical for the coefficient of variation on the coverage ratio A to be less than 10.0%. The specification of a coefficient of variation on the coverage ratio A of less than 10.0% means that the coverage ratio A between magnetic toner particles and within a magnetic toner particle is very uniform. A more uniform coverage ratio A makes the attachment force to the regulating blade more uniform and provides a better turn over of the toner in the contact region and hence is highly preferred.

There are no particular limitations on the technique for bringing the coefficient of variation on the coverage ratio A to less than 10.0%, but the use is preferred of the external addition apparatus and technique described below, which are capable of bringing about a high degree of spreading of the metal oxide fine particles, e.g., silica fine particles, over the magnetic toner particle surfaces.

This coefficient of variation on the coverage ratio A is preferably less than or equal to 8.0%.

It is also critical that the compression ratio of the magnetic toner be from at least 38% to not more than 42%. This specification of a compression ratio of from at least 38% to not more than 42% for the magnetic toner means that the magnetic toner is resistant to compression. Such a magnetic toner is resistant to compression in the contact region between the regulating blade and the toner-carrying member, and this is thought to enable the retention of an excellent flowability even in the contact region. The synergetic effect between the low attachment force to the regulating blade and the ability to retain an excellent flowability in this contact region provides an extremely good turn over (circulation) of the magnetic toner in the contact region. As a consequence, the compression ratio of the magnetic toner must be from at least 38% to not more than 42% in the present invention.

When this compression ratio is larger than 42%, the magnetic toner compresses in the contact region and a good flowability is not obtained. Due to this, turn over (circulation) of the magnetic toner in the contact region is impaired and the ghosting is not improved.

When, on the other hand, the compression ratio is smaller than 38%, it is thought that the magnetic toner does not undergo compression even in the contact region and a very good flowability is then obtained. However, because the flowability is too good, it is thought that the application of the forces, i.e., the pressure from the regulating blade and the transport force from the toner-carrying member, to the magnetic toner is impaired and the generation of magnetic toner turn over in the contact region is impaired. As a result, the difference in the amount of charge between the residual toner and the supplied toner cannot be extinguished and ghosting is not improved.

The compression ratio of the magnetic toner can be controlled into the above-described range through, for example, the average circularity and particle size distribution of the magnetic toner and the amount of addition of release agent.

This magnetic toner compression ratio is preferably from at least 39% to not more than 42%.

The magnetic toner of the present invention has a ratio [B/A] of the coverage ratio B (%)—which is the coverage ratio by inorganic fine particles that are fixed to the magnetic toner particle surface—to the coverage ratio A (%) of from at least 0.50 to not more than 0.85. This is thought to enable an excellent free rotation of the magnetic toner attached to the surface of a charging member, e.g., the regulating blade.

The specification of a B/A of from at least 0.50 to not more than 0.85 means that inorganic fine particles that are fixed to the magnetic toner particle surface are present to a certain degree and that in addition inorganic fine particles are also present in a state that enables behavior separated from the magnetic toner particle.

Here, looking again at the contact region, pressure is applied in the contact region and, even with an easily loosened magnetic toner having a small magnetic toner compression ratio as in the present invention, it is thought that free rotation of the magnetic toner tends to be impaired.

However, even for a state in which a certain amount of pressure has been applied, it is thought that the magnetic toner can undergo free rotation by having inorganic fine particles fixed to the magnetic toner particle surface be present and by having inorganic fine particles capable of behavior separate from the magnetic toner particles also be present. This is believed to be due to the generation of a bearing-like effect by the releasable inorganic fine particles sliding against the fixed inorganic fine particles. Since for this reason the magnetic toner of the present invention has a small attachment force to a member such as the regulating blade and resides in a state in which the magnetic toner can undergo free rotation, the magnetic toner fraction that has contacted the regulating blade has an extremely good tribocharging performance.

As previously described, the magnetic toner of the present invention exhibits an excellent turn over (circulation) by the magnetic toner in the contact region and an excellent free rotation by the magnetic toner that has contacted the regulating blade and for these reasons the initial rise in its charging is uniform and very rapid.

As a result, the difference in the amount of charge between the residual toner and the supplied toner is abolished and ghosting is substantially reduced.

This bearing effect and the above-described attachment force-reducing effect were found to be maximally obtained when both the fixed inorganic fine particles and the easily releasable inorganic fine particles are relatively small inorganic fine particles having a primary particle number-average particle diameter (D1) of approximately not more than 50 nm. Accordingly, the coverage ratio A and the coverage ratio B were calculated focusing on the inorganic fine particles of not more than 50 nm.

B/A is preferably from not less than 0.55 to not more than 0.80.

This coverage ratio A, coverage ratio B, and ratio [B/A] of the coverage ratio B to the coverage ratio A can be determined by the methods described below.

The weight-average particle diameter (D4) of the magnetic toner of the present invention is preferably from at least 3.0 μm to not more than 12.0 μm and more preferably is from at least 4.0 μm to not more than 10.0 μm. An excellent flowability is obtained and the latent image can be faithfully developed when the weight-average particle diameter (D4) is from at least 3.0 μm to not more than 12.0 μm. An image having an excellent dot reproducibility can be obtained as a consequence.

The magnetic toner of the present invention has a ratio [D4/D1] of the weight-average particle diameter (D4) to the number-average particle diameter (D1) preferably of not more than 1.30 and more preferably of not more than 1.25. Specifying a D4/D1 of not more than 1.30 means that the magnetic toner has a sharp particle size distribution. As previously described, the magnetic toner of the present invention has a B/A of from at least 0.50 to not more than 0.85 and, due to the inorganic fine particles capable of motion in a released state, can undergo free rotation even when subjected to pressure in the contact region. However, when the application of pressure to a magnetic toner is considered, the pressure received by the magnetic toner is believed to exhibit large particle-to-particle variations when the magnetic toner has diverse sizes. In such a case, the free rotation of magnetic toner that receives a large pressure is readily impaired and as a consequence there is a tendency for the effects of the present invention to not be fully manifested. Thus, D4/D1 is preferably not more than 1.30 in order to make the pressure received by the individual magnetic toner particles constant and provide a very good free rotation by the magnetic toner.

This D4/D1 can be adjusted into the above-described range through the selection of the method of producing the magnetic toner and adjustments in the production conditions.

The average circularity of the magnetic toner of the present invention is preferably from at least 0.935 to not more than 0.955 and is more preferably from at least 0.938 to not more than 0.950. Specifying an average circularity of from at least 0.935 to not more than 0.955 means that the magnetic toner is irregular in shape and presents unevenness.

As a general matter, a higher average circularity is believed to provide a higher flowability for the toner and to be favorable for the turn over by the toner in the contact region. However, in addition to a high coverage ratio by the inorganic fine particles, a primary aim of the present invention is to lower the attachment force between the magnetic toner and the regulating blade.

Considering the van der Waals force (F) again in this context, the toner particle diameter D referenced above is a consideration, but the radius of curvature of the region in actual contact with the flat plate is also a consideration. As a consequence, it is thought by the present inventors that an irregularly shaped toner with a small radius of curvature readily provides a smaller van der Waals force and supports an extremely good realization of the effects of the present invention. As a result, the average circularity of the toner in the present invention is preferably from at least 0.935 to not more than 0.955.

The average circularity of the magnetic toner of the present invention can be adjusted into the above-described range through the selection of the method of producing the magnetic toner and adjustments in the production conditions.

The binder resin for the magnetic toner in the present invention can be exemplified by vinyl resins, polyester resins, and so forth, but there is no particular limitation thereon and the heretofore known resin can be used.

In specific terms, the following, for example, can be used: polystyrene; styrene copolymers such as styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers, and styrene-maleate ester copolymers; polyacrylate esters; polymethacrylate esters; and polyvinyl acetate. A single one of these may be used or a plurality may be used in combination. Among the preceding, styrene copolymers and polyester resins are preferred from the standpoint of the developing characteristics and the fixing performance.

The glass-transition temperature (Tg) of the magnetic toner of the present invention is preferably from at least 40° C. to not more than 70° C. When the glass-transition temperature of the magnetic toner is from at least 40° C. to not more than 70° C., the storage stability and durability can be enhanced while maintaining a favorable fixing performance.

A charge control agent is preferably added to the magnetic toner of the present invention.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids. Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention may as necessary also incorporate a release agent in order to improve the fixing performance. Any known release agent can be used for this release agent. Specific examples are petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylene and polypropylene, and their derivatives; natural waxes, e.g., carnauba wax and candelilla wax, and their derivatives; and ester waxes. Here, the derivatives include oxidized products, block copolymers with vinyl monomers, and graft modifications. In addition, the ester wax can be a monofunctional ester wax or a multifunctional ester wax, e.g., most prominently a difunctional ester wax but also a tetrafunctional or hexafunctional ester wax.

When a release agent is used in the magnetic toner of the present invention, its content is preferably from at least 0.5 mass parts to not more than 10 mass parts per 100 mass parts of the binder resin. When the release agent content is in the indicated range, the fixing performance is enhanced while the storage stability of the magnetic toner is not impaired.

The release agent can be incorporated in the binder resin by, for example, a method in which, during resin production, the resin is dissolved in a solvent, the temperature of the resin solution is raised, and addition and mixing are carried out while stirring, or a method in which addition is carried out during melt kneading during production of the magnetic toner.

The peak temperature (also referred to below as the melting point) of the maximum endothermic peak measured on the release agent using a differential scanning calorimeter (DSC) is preferably from at least 60° C. to not more than 140° C. and more preferably is from at least 70° C. to not more than 130° C. When the peak temperature (melting point) of the maximum endothermic peak is from at least 60° C. to not more than 140° C., the magnetic toner is easily plasticized during fixing and the fixing performance is enhanced. This is also preferred because it works against the appearance of outmigration by the release agent even during long-term storage.

The peak temperature of the maximum endothermic peak of the release agent is measured in the present invention based on ASTM D3418-82 using a "Q1000" differential scanning calorimeter (TA Instruments, Inc.). Temperature correction in the instrument detection section is carried out using the melting points of indium and zinc, while the heat of fusion of indium is used to correct the amount of heat.

Specifically, approximately 10 mg of the measurement sample is precisely weighed out and this is introduced into an aluminum pan. Using an empty aluminum pan as the reference, the measurement is performed at a rate of temperature rise of 10° C./min in the measurement temperature range from 30 to 200° C. For the measurement, the temperature is raised to 200° C. and is then dropped to 30° C. at 10° C./min and is thereafter raised again at 10° C./min. The peak temperature of the maximum endothermic peak is determined for the release agent from the DSC curve in the temperature range of 30 to 200° C. for this second temperature ramp-up step.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of this magnetic body is preferably not more than 0.50 μm and more preferably is from 0.05 μm to 0.30 μm.

This magnetic body preferably has the following magnetic properties for the application of 79.6 kA/m: a coercive force ($H_c$) preferably from 1.6 to 12.0 kA/m; a intensity of magnetization ($\sigma_s$) preferably from 30 to 90 $Am^2/kg$ and more preferably from 40 to 80 $Am^2/kg$; and a residual magnetization ($\sigma_r$) preferably from 1 to 10 $Am^2/kg$ and more preferably from 1.5 to 8 $Am^2/kg$.

The magnetic toner of the present invention preferably contains from at least 35 mass % to not more than 50 mass % of the magnetic body and more preferably contains from at least 40 mass % to not more than 50 mass %.

When the content of the magnetic body in the magnetic toner is less than 35 mass %, the magnetic attraction to the magnet roll within the toner-carrying member declines and fogging is readily produced. When, on the other hand, the magnetic body content exceeds 50 mass %, the density may decline due to a decline in the developing performance.

The content of the magnetic body in the magnetic toner can be measured using a Q5000IR TGA thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

The magnetic toner of the present invention has, for a magnetic field of 79.6 kA/m, a ratio [σr/σs] of the residual magnetization (σr) to the intensity of magnetization (σs) of preferably not more than 0.09 and more preferably not more than 0.06. The specification of a small σr/σs means that the magnetic toner exhibits little residual magnetization. Here, when one considers a magnetic monocomponent development system, the magnetic toner is captured or discharged by the toner-carrying member under the effect of the multipole magnet present in the toner-carrying member. The discharged magnetic toner (the magnetic toner that has disengaged from the toner-carrying member) is resistant to magnetic cohesion when [σr/σs] has a small value. Such a magnetic toner does not undergo magnetic cohesion when it attaches to the toner-carrying member at a recapture pole and enters the contact region, and as a consequence control of the amount of toner may be carried out properly and the amount of magnetic toner on the toner-carrying member is stable. Due to this, the amount of magnetic toner in the contact region is stabilized and, as previously described, very good turn over by the magnetic toner in the contact region is obtained and the distribution of the amount of charge becomes very sharp. As a result, not only is ghosting improved, but an image with a high image density and little fogging can be obtained, which is highly preferred.

[σr/σs] can be adjusted into the range indicated above by adjusting the particle diameter and shape of the magnetic body present in the magnetic toner and by adjusting the additives added during production of the magnetic body. Specifically, a high σs can be maintained and σr can be lowered by the addition of, for example, silica or phosphorus to the magnetic body. In addition, σr declines as the surface area of the magnetic body declines, and σr is also smaller for a spherical shape, where there is little magnetic anisotropy, than for an octahedron. A very low σr can be achieved through a combination of the preceding, and [σr/σs] can thereby be controlled to not more than 0.09.

The intensity of magnetization (σs) and residual magnetization (σr) of the magnetic toner and magnetic body is measured in the present invention at a room temperature of 25° C. and an external magnetic field of 79.6 kA/m using a VSM P-1-10 vibrating sample magnetometer (Toei Industry Co., Ltd.). The reason for measuring the magnetic characteristics of the magnetic toner at an external magnetic field of 79.6 kA/m is as follows: the magnetic force at the development pole of the magnet roller installed in a toner-carrying member is generally around 79.6 kA/m (1000 oersted), and toner behavior in the developing zone can therefore be comprehended by measuring the residual magnetization at an external magnetic field of 79.6 kA/m.

The magnetic toner of the present invention contains inorganic fine particles at the magnetic toner particle surface.

The inorganic fine particles present on the magnetic toner particle surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one type of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles. The reasons for this are that silica fine particles not only provide the best balance with regard to imparting charging performance and flowability, but are also excellent from the standpoint of lowering the aggregative forces between the magnetic toners.

The reason why silica fine particles are excellent from the standpoint of lowering the aggregative forces between the magnetic toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one type of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a reduction in foggin and a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and to at least 80 mass % with reference to the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm and more preferably is from at least 10 nm to not more than 35 nm. Bringing the number-average particle diameter (D1) of the primary particles in the inorganic fine particles into the indicated range makes it easier to control of the coverage ratio A and B/A. When the primary particle number-average particle diameter (D1) is less than 5 nm, the inorganic fine particles tend to aggregate with one another and obtaining a large value for B/A becomes problematic and the coefficient of variation on the coverage ratio A is also prone to assume large values. When, on the other hand, the primary particle number-average particle diameter (D1) exceeds 50 nm, the coverage ratio A is prone to be small even at large amounts of addition of the inorganic fine particles; in addition, B/A will also tend to have a low value because it becomes difficult for the inorganic fine particles to become fixed to the magnetic toner particles. That is, it is difficult to obtain the above-described attachment force-reducing effect and bearing effect when the primary particle number-average particle diameter (D1) is greater than 50 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a Henschel mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass parts to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS 28830 (2001). A "TriStar300 (Shimadzu Corporation) automatic specific surface area • pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A and also from the standpoint of the image density and fogging.

Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, or a strontium titanate powder; or a spacer particle such as silica and resin particle, may also be added in small amounts that do not influence the effects of the present invention.

Examples of methods for producing the magnetic toner of the present invention are provided below, but there is no intent to limit the production method to these.

The magnetic toner of the present invention can be produced by any known method that enables adjustment of the coverage ratio A, the variation coefficient of coverage ratio A and B/A and that preferably has a step in which the average circularity and [DA/D1] can be adjusted, while the other production steps are not particularly limited.

The following method is a favorable example of such a production method. First, the binder resin and magnetic body and as necessary other starting materials, e.g., a release agent and a charge control agent, are thoroughly mixed using a mixer such as a Henschel mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during micropulverization using a Turbo Mill. A lower exhaust gas temperature (for example, no more than 40° C.) provides a smaller value for the average circularity while a higher exhaust gas temperature (for example, around 50° C.) provides a higher value for the average circularity.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Among the preceding, adjusting the amount of fines and coarse powder is preferred for adjusting [D4/D1], and this can be exemplified by a method in which classification is carried out using an Elbow Jet. In specific terms, [D4/D1] can be reduced by reducing the amount of fines.

Figure 6:
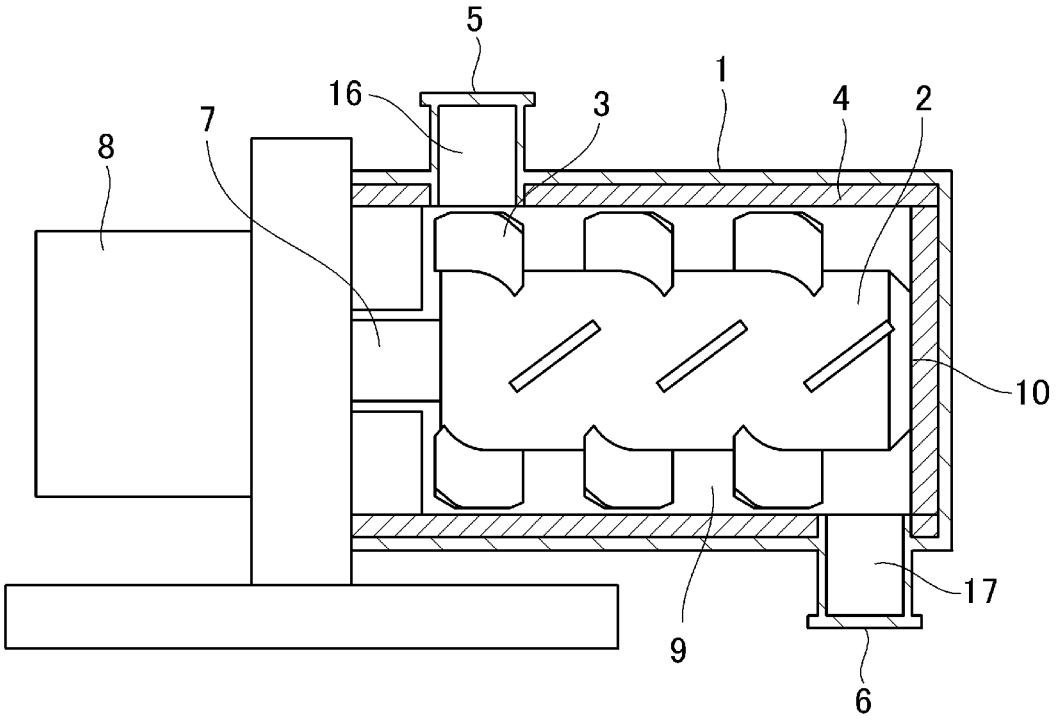
FIG. 6 is a schematic diagram that shows an example of a mixing process apparatus that can be used for the external addition and mixing of inorganic fine particles.

A known mixing process apparatus, e.g., the mixers described above, can be used for the external addition and mixing of the inorganic fine particles; however, an apparatus as shown in FIG. 6 is preferred from the standpoint of enabling facile control of the coverage ratio A, B/A, and the coefficient of variation on the coverage ratio A.

FIG. 6 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 7:
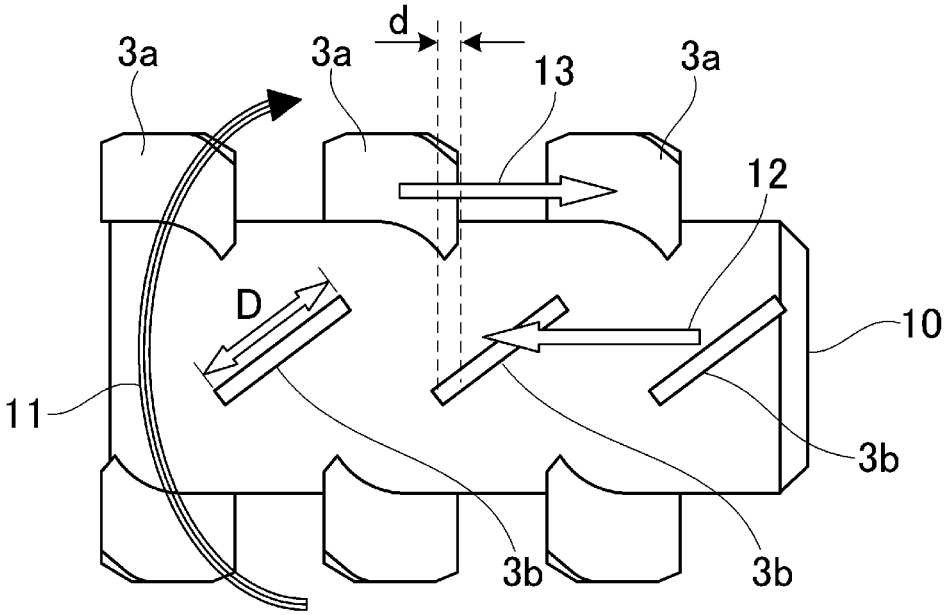
FIG. 7 is a schematic diagram that shows an example of the structure of a stirring member used in the mixing process apparatus.

On the other hand, FIG. 7 is a schematic diagram that shows an example of the structure of the stirring member used in the aforementioned mixing process apparatus.

The external addition and mixing process for the inorganic fine particles is described below using FIGS. 6 and 7.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 6, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 7, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 6, the direction toward the product discharge port 6 from the raw material inlet port 5 (the direction to the right in FIG. 6) is the "forward direction".

That is, as shown in FIG. 7, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 7, two members at an interval of 180° with each other form a set of the stirring members 3*a*, 3*b* on the rotating member 2, but a larger number of members may form a set, such as three at an interval of 120° or four at an interval of 90°.

In the example shown in FIG. 7, a total of twelve stirring members 3*a*, 3*b* are formed at an equal interval.

Furthermore, D in FIG. 7 indicates the width of a stirring member and d indicates the distance that represents the overlapping portion of a stirring member. In FIG. 7, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 7 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 7, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 6 and 7.

The apparatus shown in FIG. 6 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 6 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 6 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 6.

More specifically, with regard to the conditions for the external addition and mixing process, controlling the power of the drive member 8 to from at least 0.2 W/g to not more than 2.0 W/g is preferred in terms of obtaining the coverage ratio A, B/A, and coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 6, the volume of the processing space 9 in the apparatus is $2.0\times10^{-3}$ $m^3$, the rpm of the stirring members—when the shape of the stirring members 3 is as shown in FIG. 7—is preferably from at least 1000 rpm to not more than 3000 rpm. The coverage ratio A, B/A, and coefficient of variation on the coverage ratio A as specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 8:
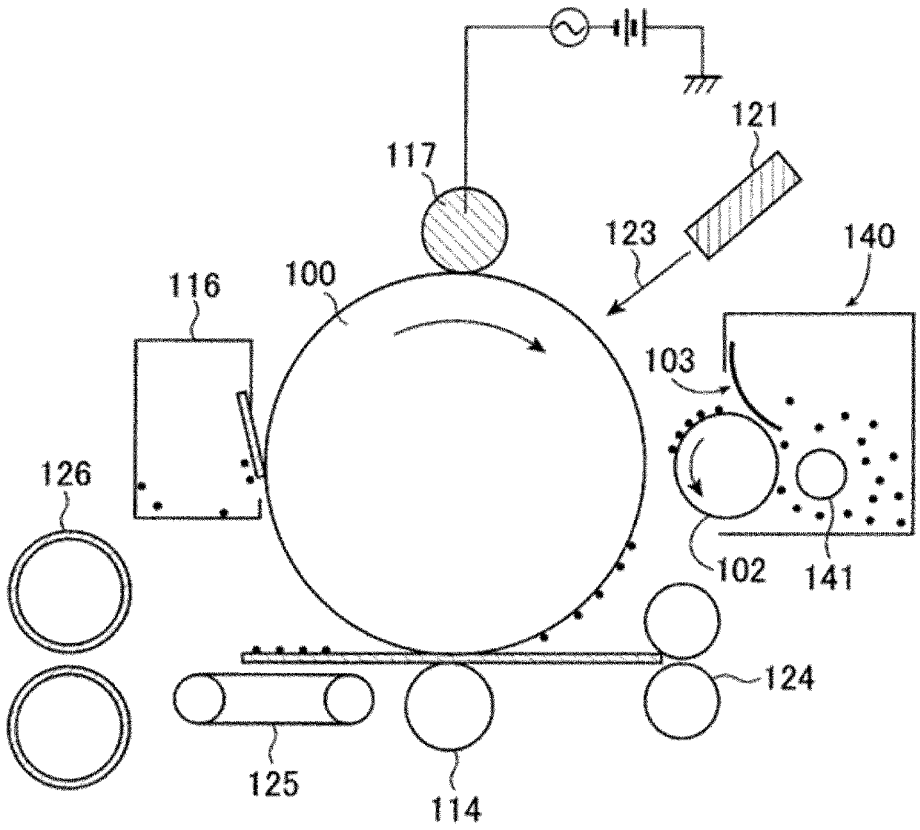
FIG. 8 is a diagram that shows an example of an image-forming apparatus.

An example of an image-forming apparatus that can advantageously use the magnetic toner of the present invention is specifically described below with reference to FIG. 8. In FIG. 8, 100 is an electrostatic latent image-bearing member (also referred to below as a photosensitive member), and the following, inter alia, are disposed on its circumference: a charging member (also referred to below as charging roller) 117, a developing device 140 having a toner-carrying member 102, a transfer member (also referred to below as transfer roller) 114, a cleaner 116, a fixing unit 126, and a register roller 124. The electrostatic latent image-bearing member 100 is charged by the charging member 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer member 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner 116.

The methods for measuring the various properties related to the toner according to the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper (U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a(\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation}(\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 9:
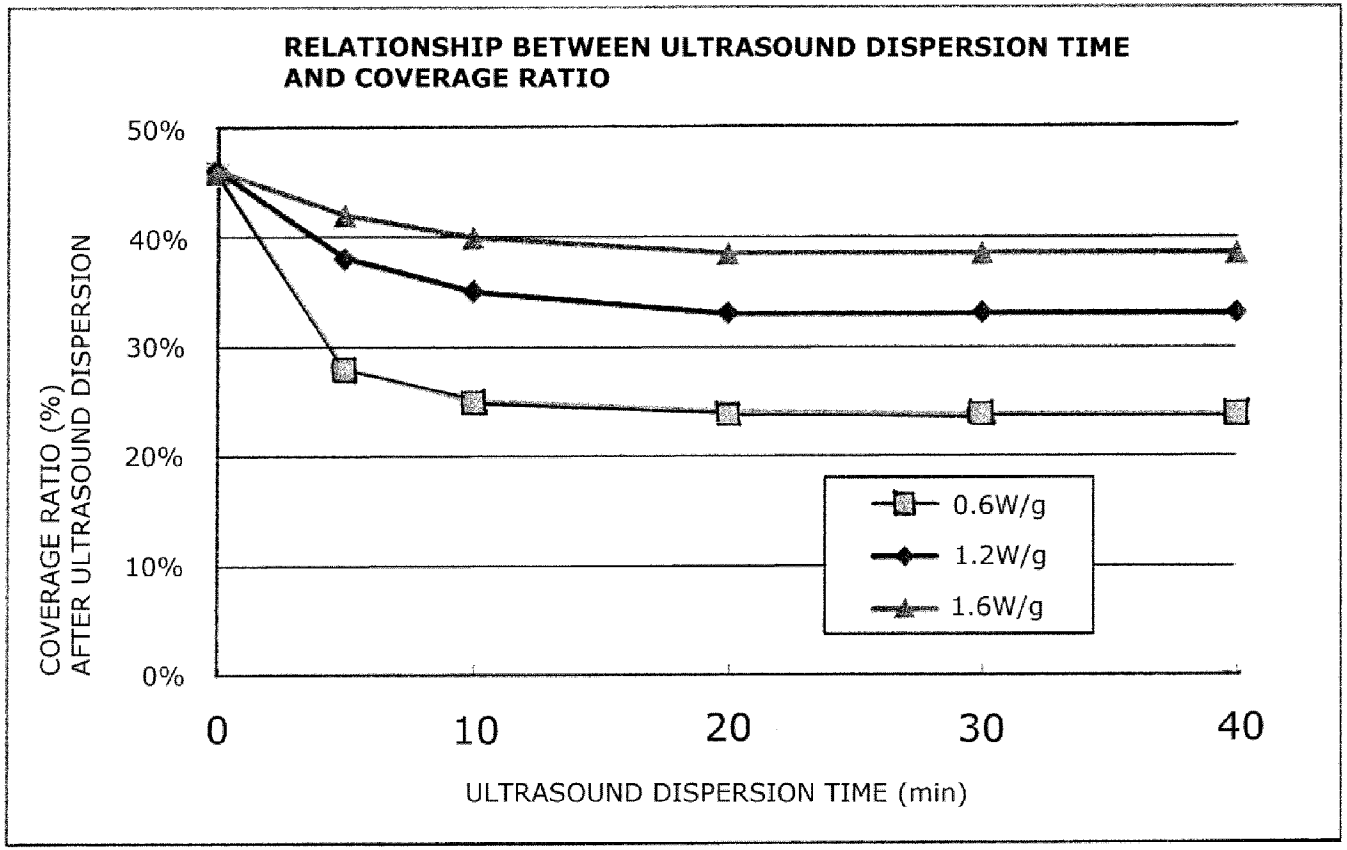
FIG. 9 is a diagram that shows an example of the relationship between the ultrasound dispersion time and the coverage ratio.

As an example, FIG. 9 shows the relationship between the ultrasound dispersion time and the coverage ratio calculated post-ultrasound dispersion, for magnetic toners in which the coverage ratio A was brought to 46% using the apparatus shown in FIG. 6 at three different external addition intensities. FIG. 9 was constructed by calculating, using the same procedure as for the calculation of coverage ratio A as described above, the coverage ratio of a magnetic toner provided by removing the inorganic fine particles by ultrasound dispersion by the method described below and then drying.

FIG. 9 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing using autofocus. The focus adjustment process is repeated to achieve focus at 100000×.

After this, the particle diameter is measured on at least 300 inorganic fine particles on the magnetic toner surface and the number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner Particles 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to -4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic particles are attracted by a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass%)=silica content (mass%) in the magnetic toner −silica content (mass%) in particle *A* amount of externally added titania fine particles (mass%)=titania content (mass%) in the magnetic toner 31 {titania content (mass%) in the magnetic body×magnetic body content *W*/100} amount of externally added alumina fine particles (mass%)=alumina content (mass%) in the magnetic toner 31 {alumina content (mass%) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface After carrying out the procedure, "Removing the unfixed inorganic fine particles", in the method for calculating the coverage ratio B and thereafter drying the toner, the proportion of the silica fine particles in the metal oxide fine particles can be calculated by carrying out the same procedures as in the method of (1) to (5) described above.

<Method for Measuring the Weight-Average Particle Diameter (D4) and the Number Average Particle Diameter (D1) of the Magnetic Toner>

The weight-average particle diameter (D4) and the number average particle diameter (D1) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of about 5%. Measurement is then performed until the number of measured particles reaches 50000.

(7) The measurement data is analyzed by the previously cited software provided with the instrument and the weight-average particle diameter (D4) and the number average particle diameter (D1) are calculated. When set to graph/volume % with the dedicated software, the "average diameter" on the "analysis/volumetric statistical value (arithmetic average)" screen is the weight-average particle diameter (D4), and when set to graph/number % with the dedicated software, the "average diameter" on the "analysis/numerical statistical value (arithmetic average)" screen is the number-average particle diameter (D1).

<Method of Measuring the Average Circularity of the Magnetic Toner>

The average circularity of the magnetic toner is measured with the "FPIA-3000" (Sysmex Corporation), a flow-type particle image analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant about 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of at least 10° C. and no more than 40° C. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a prescribed amount of ion-exchanged water is introduced into the water tank and approximately 2 mL of the aforementioned Contaminon N is also added to the water tank.

The previously cited flow-type particle image analyzer (fitted with a standard objective lens (10×)) is used for the measurement, and Particle Sheath "PSE-900A" (Sysmex Corporation) is used for the sheath solution. The dispersion prepared according to the procedure described above is introduced into the flow-type particle image analyzer and 3000 of the magnetic toner are measured according to total count mode in HPF measurement mode. The average circularity of the magnetic toner is determined with the binarization threshold value during particle analysis set at 85% and the analyzed particle diameter limited to a circle-equivalent diameter of from at least 1.985 μm to less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In the present invention, the flow-type particle image analyzer used had been calibrated by the Sysmex Corporation and had been issued a calibration certificate by the Sysmex Corporation. The measurements are carried out under the same measurement and analysis conditions as when the calibration certificate was received, with the exception that the analyzed particle diameter is limited to a circle-equivalent diameter of from at least 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow. The sample passing through the flat sheath flow cell is exposed to stroboscopic light at an interval of 1/60 seconds, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 pixels (0.37×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image. The circularity is defined as the value provided by dividing the circumference of the circle determined from the circle-equivalent diameter by the periphery length of the particle's projected image and is calculated using the following formula.

$$\text{circularity}=2\times(\pi\times S)^{1/2}/L$$

The circularity is 1.000 when the particle image is a circle, and the value of the circularity declines as the degree of irregularity in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Method of Measuring the Compression Ratio of the Magnetic Toner>

The compression ratio of the magnetic toner is calculated in the present invention using the following formula.

$$\text{compression ratio}(\%)=\{1-(\text{bulk density}/\text{packed bulk density})\}\times 100$$

The bulk density and packed bulk density here are measured by the following methods using a Powder Tester (Hosokawa Micron).

The magnetic toner is passed through a screen with an aperture of 608 μm (24 mesh) into a cylindrical container having a diameter of 5.03 cm and a capacity of 100 $cm^3$ and is uniformly supplied for 30 seconds from the top. The supply rate at this time is adjusted so the magnetic toner completely fills the cylindrical container in 30 seconds. Immediately after the 30-second feed, the magnetic toner at the top of the cylindrical container is leveled off with a blade and the mass of the magnetic toner in the cylindrical container is measured and the bulk density ($g/cm^3$ is obtained from magnetic toner mass/100. This procedure is carried out five times and the arithmetic average value is used as the bulk density ($g/cm^3$) in the present invention.

A cylindrical cap is installed immediately after measurement of the bulk density; the magnetic toner is added up to its upper edge; and 180 taps are administered at a tap height of 1.8 cm. Once this is finished, the cap is removed and the magnetic toner at the top of the cylindrical container is leveled off with a blade; the mass of the magnetic toner in the cylindrical container is measured; and the tapping density ($g/cm^3$) is obtained from magnetic toner mass/100. This procedure is carried out five times and the arithmetic average value is used as the tapping density in the present invention.

EXAMPLES

The present invention is described in additional detail through the examples and comparative examples provided below, but the present invention is in no way restricted to these. The % and number of parts in the examples and comparative examples, unless specifically indicated otherwise, are in all instances on a mass basis.

<Magnetic Body 1 Production Example>

An aqueous solution containing ferrous hydroxide was prepared by mixing the following in an aqueous solution of ferrous sulfate: a sodium hydroxide solution at 1.1 equivalent with reference to the iron, $SiO_2$ in an amount that provided 0.60 mass % as silicon with reference to the iron, and sodium phosphate in an amount that provided 0.15 mass % as phosphorus with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was run while blowing in air and maintaining the slurry at pH 7.5 to obtain a slurry containing magnetic iron oxide. This slurry was filtered, washed, dried, and ground to obtain a magnetic body 1 that had a volume-average particle diameter (Dv) of 0.21 μm and a intensity of magnetization of 66.7 $Am^2/kg$ and residual magnetization of 4.0 $Am^2/kg$ for a magnetic field of 79.6 kA/m (1000 oersted).

<Magnetic Body 2 Production Example>

An aqueous solution containing ferrous hydroxide was prepared by mixing the following in an aqueous solution of ferrous sulfate: a sodium hydroxide solution at 1.1 equivalent with reference to the iron and $SiO_2$ in an amount that provided 0.60 mass % as silicon with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was run while blowing in air and maintaining the slurry at pH 8.5 to obtain a slurry containing magnetic iron oxide. This slurry was filtered, washed, dried, and ground to obtain a magnetic body 2 that had a volume-average particle diameter (Dv) of 0.22 μm and a intensity of magnetization of 66.1 $Am^2/kg$ and residual magnetization of 5.9 $Am^2/kg$ for a magnetic field of 79.6 kA/m (1000 oersted).

<Magnetic Body 3 Production Example>

An aqueous solution containing ferrous hydroxide was prepared by mixing the following in an aqueous solution of ferrous sulfate: a sodium hydroxide solution at 1.1 equivalent with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was run while blowing in air and maintaining the slurry at pH 12.8 to obtain a slurry containing magnetic iron oxide. This slurry was filtered, washed, dried, and ground to obtain a magnetic body 3 that had a volume-average particle diameter (Dv) of 0.20 μm and a intensity of magnetization of 65.9 $Am^2/kg$ and residual magnetization of 7.3 $Am^2/kg$ for a magnetic field of 79.6 kA/m (1000 oersted).

<Production of Magnetic Toner Particle 1>

| | |
|---|---|
| styrene/n-butyl acrylate copolymer 1 (St/nBA copolymer 1 in Table 1) (mass ratio: styrene/n-butyl acrylate = 78/22, glass-transition temperature Tg: 58° C., peak molecular weight: 8500) | 100.0 mass parts |
| magnetic body 1 | 95.0 mass parts |
| polyethylene wax (melting point: 102° C.) | 5.0 mass parts |
| iron complex of a monoazo dye (T-77: Hodogaya Chemical Co., Ltd.) | 2.0 mass parts |

The raw materials listed above were preliminarily mixed using an FM10C Henschel mixer (Mitsui Miike Chemical Engineering Machinery Co., Ltd.) and were then kneaded with a twin-screw kneader/extruder (PCM-30, Ikegai Ironworks Corporation) set at a rotation rate of 250 rpm with the set temperature being adjusted to provide a direct temperature in the vicinity of the outlet for the kneaded material of 145° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 25 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 8.4 μm. The production conditions for toner particle 1 are shown in Table 1.

<Production of Magnetic Toner Particle 2>

Magnetic toner particle 2 was obtained proceeding in the same manner as in the production of magnetic toner particle 1, with the exception that magnetic body 2 was used in place of magnetic body 1. The production conditions for magnetic toner particle 2 are shown in Table 1.

<Production of Magnetic Toner Particle 3>

Magnetic toner particle 3 was obtained proceeding in the same manner as in the production of magnetic toner particle 2, with the exception that the apparatus used for fine pulverization was changed to a jet mill pulverizer. The production conditions for magnetic toner particle 3 are shown in Table 1.

<Production of Magnetic Toner Particle 4>

Magnetic toner particle 4 was obtained proceeding in the same manner as in the production of magnetic toner particle 2, with the exception that the exhaust temperature of the Turbo Mill T-250 used in the production of magnetic toner particle 2 was controlled to a somewhat high 44° C. in order to adjust the average circularity of the magnetic toner particles upward. The production conditions for magnetic toner particle 4 are shown in Table 1.

<Production of Magnetic Toner Particle 5>

Magnetic toner particle 5 was obtained proceeding in the same manner as in the production of magnetic toner particle 1, with the exception that magnetic body 3 was used in place of magnetic body 1. The production conditions for magnetic toner particle 5 are shown in Table 1.

<Production of Magnetic Toner Particles 6 and 7>

Magnetic toner particles 6 and 7 were obtained proceeding in the same manner as in the production of magnetic toner particle 5, with the exception that the position of the classification edge in the multifraction classifier in the classification step in the production of magnetic toner particle 5 was adjusted so as to incorporate fines. The production conditions for magnetic toners 6 and 7 are shown in Table 1.

<Production of Magnetic Toner Particle 8>

Magnetic toner particle 8 was obtained proceeding in the same manner as in the production of magnetic toner particle 3, with the exception that magnetic body 3 was used in place of the magnetic body 2 used in the production of magnetic toner particle 3 and the classification conditions were changed in order to incorporate more fines. The production conditions for magnetic toner particle 8 are shown in Table 1.

<Production of Magnetic Toner Particle 9>

Magnetic toner particle 9 was obtained proceeding in the same manner as in the production of magnetic toner particle 4, with the exception that magnetic body 3 was used in place of the magnetic body 2 used in the production of magnetic toner particle 4 and the classification conditions were changed in order to incorporate more fines. The production conditions for magnetic toner particle 9 are shown in Table 1.

<Production of Magnetic Toner Particle 10>

Magnetic toner particle 10 was obtained proceeding in the same manner as in the production of magnetic toner particle 8, with the exception that the styrene/n-butyl acrylate copolymer (mass ratio: 78/22, Tg: 58° C., peak molecular weight: 8500) used in the production of magnetic toner particle 8 was changed to styrene/n-butyl acrylate copolymer 2 (St/nBA copolymer in Table 1, mass ratio: 78/22, Tg: 57° C., peak molecular weight: 6500). The production conditions for magnetic toner particle 10 are shown in Table 1.

<Production of Magnetic Toner Particle 11>

Magnetic toner particle 11 was obtained proceeding in the same manner as in the production of magnetic toner particle 9, with the exception that the exhaust temperature of the Turbo Mill T-250 in the production of magnetic toner particle 9 was controlled to an even higher 48° C. in order to adjust the average circularity of the magnetic toner particles upward. The production conditions for magnetic toner particle 11 are shown in Table 1.

<Production of Magnetic Toner Particle 12>

Magnetic toner particle 12 was obtained proceeding in the same manner as in the production of magnetic toner particle 3, with the exception that the amount of polyethylene wax addition used in the production of magnetic toner particle 3 was changed to 7 mass parts and the classification conditions were changed to incorporate fines. The production conditions for magnetic toner particle 12 are shown in Table 1.

<Production of Magnetic Toner Particle 13>

Magnetic toner particle 13 was obtained proceeding in the same manner as in the production of magnetic toner particle 4, with the exception that the amount of polyethylene wax addition used in the production of magnetic toner 4 was changed to 3 mass parts and the position of the classification edge for the multifraction classifier in the classification step was changed in order to exclude the fines. The production conditions for magnetic toner particle 13 are shown in Table 1.

<Production of Magnetic Toner Particle 14>

100.0 mass parts of magnetic toner particles 2 and 0.5 mass parts of a hydrophobic silica were introduced into an FM10C Henschel mixer (Mitsui Miike Chemical Engineering Machinery Co., Ltd.) and mixing and stirring were carried out for 2 minutes at 3000 rpm. The hydrophobic silica used here was obtained by subjecting 100 mass parts of a silica with a primary particle number-average particle diameter (D1) of 12 nm and a BET specific surface area of 200 $m^2/g$ to surface treatment with 10 mass parts hexamethyldisilazane and then treatment with 10 mass parts of a dimethylsilicone oil.

Then, the mixed and stirred material was subjected to surface modification using a Meteorainbow (Nippon Pneumatic Mfg. Co., Ltd.), which is a device that carries out the surface modification of magnetic toner particles using a hot wind blast. The surface modification conditions were a raw material feed rate of 2 kg/hr, a hot wind flow rate of 700 L/min, and a hot wind ejection temperature of 300° C. Magnetic toner particle 14 was obtained by carrying out this hot wind treatment.

<Production of Magnetic Toner Particle 15>

Magnetic toner particle 15 was obtained proceeding in the same manner as in the production of magnetic toner particle 14, with the exception that the amount of addition of the hydrophobic silica added in the production of magnetic toner particle 14 was made 1.5 mass parts.

TABLE 1

| | binder resin | magnetic body | amount of wax addition | pulverization apparatus | exhaust temperature of the pulverization |
|---|---|---|---|---|---|
| toner particle 1 | St/nBA copolymer 1 | magnetic body 1 | polyethylene: 5 mass parts | Turbo Mill | 38° C. |
| toner particle 2 | St/nBA copolymer 1 | magnetic body 2 | polyethylene: 5 mass parts | Turbo Mill | 38° C. |
| toner particle 3 | St/nBA copolymer 1 | magnetic body 2 | polyethylene: 5 mass parts | Jet mill | — |
| toner particle 4 | St/nBA copolymer 1 | magnetic body 2 | polyethylene: 5 mass parts | Turbo Mill | 44° C. |
| toner particle 5 | St/nBA copolymer 1 | magnetic body 3 | polyethylene: 5 mass parts | Turbo Mill | 38° C. |
| toner particle 6 | St/nBA copolymer 1 | magnetic body 3 | polyethylene: 5 mass parts | Turbo Mill | 38° C. |
| toner particle 7 | St/nBA copolymer 1 | magnetic body 3 | polyethylene: 5 mass parts | Turbo Mill | 38° C. |
| toner particle 8 | St/nBA copolymer 1 | magnetic body 3 | polyethylene: 5 mass parts | Jet mill | — |
| toner particle 9 | St/nBA copolymer 1 | magnetic body 3 | polyethylene: 5 mass parts | Turbo Mill | 44° C. |
| toner particle 10 | St/nBA copolymer 2 | magnetic body 3 | polyethylene: 5 mass parts | Jet mill | — |
| toner particle 11 | St/nBA copolymer 1 | magnetic body 3 | polyethylene: 5 mass parts | Turbo Mill | 48° C. |
| toner particle 12 | St/nBA copolymer 1 | magnetic body 2 | polyethylene: 7 mass parts | Jet mill | — |
| toner particle 13 | St/nBA copolymer 1 | magnetic body 2 | polyethylene: 3 mass parts | Turbo Mill | 44° C. |
| toner particle 14 | St/nBA copolymer 1 | magnetic body 2 | polyethylene: 5 mass parts | Turbo Mill | 38° C. |
| toner particle 15 | St/nBA copolymer 1 | magnetic body 2 | polyethylene: 5 mass parts | Turbo Mill | 38° C. |

<Magnetic Toner Production Example 1>

An external addition and mixing process was carried out using the apparatus shown in FIG. 6 on the magnetic toner particle 1 provided by Magnetic Toner Particle Production Example 1.

In this example, the diameter of the inner circumference of the main casing 1 of the apparatus shown in FIG. 6 was 130 mm; the apparatus used had a volume for the processing space 9 of $2.0\times10^{-3}$ $m^3$; the rated power for the drive member 8 was 5.5 kW; and the stirring member 3 had the shape given in FIG. 7. The overlap width d in FIG. 7 between the stirring member 3*a* and the stirring member 3*b* was 0.25 D with respect to the maximum width D of the stirring member 3, and the clearance between the stirring member 3 and the inner circumference of the main casing 1 was 3.0 mm.

100 mass parts (500 g) of magnetic toner particles 1 and 2.00 mass parts of the silica fine particles 1 described below were introduced into the apparatus shown in FIG. 6 having the apparatus structure described above.

Silica fine particles 1 were obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 2.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions of magnetic toner 1 are shown in Table 2, and properties of magnetic toner 1 are shown in Table 3, respectively.

<Magnetic Toner Production Examples 2 to 4, 7, 8, 11 to 17, and 19 to 33 and Comparative Magnetic Toner Production Examples 1 to 19 and 21 to 30>

Magnetic toners 2 to 4, 7, 8, 11 to 17, and 19 to 33, and comparative magnetic toners 1 to 19 and 21 to 30 were obtained using the magnetic toner particles shown in Table 2 in Magnetic Toner Production Example 1 in place of magnetic toner particle 1 and by performing respective external addition processing using the external addition recipes, external addition apparatuses, and external addition conditions shown in Table 2. The properties of each toner are shown in Table 3.

Anatase titanium oxide (BET specific surface area: 80 $m^2/g$, primary particle number-average particle diameter (D1): 15 nm, treated with 12 mass % isobutyltrimethoxysilane) was used for the titania fine particles referenced in Table 2 and alumina fine particles (BET specific surface area: 70 $m^2/g$, primary particle number-average particle diameter (D1): 17 nm, treated with 10 mass % isobutyltrimethoxysilane) were used for the alumina fine particles referenced in Table 2.

Table 2 gives the proportion (mass %) of silica fine particles for the addition of titania fine particles and/or alumina fine particles in addition to silica fine particles.

For comparative magnetic toners 15 to 19, pre-mixing was not performed and the external addition and mixing process was carried out immediately after introduction.

The hybridizer referenced in Table 2 is the Hybridizer Model 1 (Nara Machinery Co., Ltd.), and the Henschel mixer referenced in Table 2 is the FM10C (Mitsui Miike Chemical Engineering Machinery Co., Ltd.).

<Magnetic Toner Production Example 5>

A magnetic toner 5 was obtained by following the same procedure as in Magnetic Toner Production Example 2, with the exception that silica fine particles 2 were used in place of the silica fine particles 1. Silica fine particles 2 were obtained by performing the same surface treatment as with silica fine particles 1, but on a silica that had a BET specific area of 200 $m^2/g$ and a primary particle number-average particle diameter (D1) of 12 nm. A value of 14 nm was obtained when magnetic toner 5 was submitted to magnification and observation with a scanning electron microscope and the number-average particle diameter of the primary particles of the silica fine particles on the magnetic toner surface was measured. The external addition conditions and properties of magnetic toner 5 are shown in Table 2 and Table 3, respectively.

<Magnetic Toner Production Example 6>

A magnetic toner 6 was obtained by following the same procedure as in Magnetic Toner Production Example 2, with the exception that silica fine particles 3 were used in place of the silica fine particles 1. Silica fine particles 3 were obtained by performing the same surface treatment as with silica fine particles 1, but on a silica that had a BET specific area of 90 $m^2/g$ and a primary particle number-average particle diameter (D1) of 25 nm. A value of 28 nm was obtained when magnetic toner 6 was submitted to magnification and observation with a scanning electron microscope and the number-average particle diameter of the primary particles of the silica fine particles on the magnetic toner surface was measured. The external addition conditions and properties of magnetic toner 6 are shown in Table 2 and Table 3, respectively.

<Magnetic Toner Production Example 9>

The external addition and mixing process was performed according to the following procedure using the same apparatus as in Magnetic Toner Production Example 1.

In Magnetic Toner Production Example 1, the magnetic toner particles 1 was changed to the magnetic toner particles 2, and, as shown in Table 2, the silica fine particle 1 (2.00 mass parts) was changed to silica fine particle 1 (1.70 mass parts) and titania fine particles (0.30 mass parts).

First, 100 mass parts of magnetic toner particles 2, 0.70 mass parts of the silica fine particles, and 0.30 mass parts of the titania fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining silica fine particles (1.00 mass part with reference to 100 mass parts of magnetic toner particle) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes. After the external addition and mixing process, the coarse particles and so forth were removed using a circular vibrating screen as in Magnetic Toner Production Example 1 to obtain magnetic toner 9. The external addition conditions and properties of magnetic toner 9 are shown in Table 2 and Table 3, respectively.

<Magnetic Toner Production Example 10>

The external addition and mixing process was performed according to the following procedure using the same apparatus as in Magnetic Toner Production Example 1.

In Magnetic Toner Production Example 1, as shown in Table 2, the magnetic toner particle 1 is replaced with the magnetic toner particle 2 and the silica fine particle 1 (2.00 mass parts) to be added was changed to silica fine particle 1 (1.70 mass parts) and titania fine particles (0.30 mass parts).

First, 100 mass parts of magnetic toner particles 2 and 1.70 mass parts of the silica fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining titania fine particles (0.30 mass parts with reference to 100 mass parts of magnetic toner particle) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes. After the external addition and mixing process, the coarse particles and so forth were removed using a circular vibrating screen as in Magnetic Toner Production Example 1 to obtain magnetic toner 10. The external addition conditions and properties of magnetic toner 10 are shown in Table 2 and Table 3, respectively.

<Magnetic Toner Production Example 18>

Magnetic toner 18 was obtained proceeding as in Magnetic Toner Production Example 6, with the exception that the fine silica particle 3 was changed to 1.80mass parts. A value of 28 nm was obtained when magnetic toner 18 was submitted to magnification and observation with a scanning electron microscope and the number-average particle diameter of the primary particles of the silica fine particles on the magnetic toner surface was measured. The external addition conditions and properties of magnetic toner 18 are shown in Table 2 and Table 3, respectively.

<Comparative Magnetic Toner Production Example 20>

A comparative magnetic toner 20 was obtained by following the same procedure as in Magnetic Toner Production Example 1, with the exception that silica fine particles 4 were used in place of the silica fine particles 1. Silica fine particles 4 were obtained by performing the same surface treatment as with silica fine particles 1, but on a silica that had a BET specific area of 30 $m^2/g$ and a primary particle number-average particle diameter (D1) of 51 nm. A value of 53 nm was obtained when comparative magnetic toner 20 was submitted to magnification and observation with a scanning electron microscope and the number-average particle diameter of the primary particles of the silica fine particles on the magnetic toner surface was measured. The external addition conditions and properties of comparative magnetic toner 20 are shown in Table 2 and Table 3, respectively.

TABLE 2

| magnetic toner number | magnetic toner particle | inorganic fine particles (mass parts) silica fine particles | titania fine particles | alumina fine particles | content of the silica fine particles (mass %) | content of silica fine particles in the fixed inorganic fine particles (mass %) | external addition conditions external addition apparatus | mixing conditions | mixing time |
|---|---|---|---|---|---|---|---|---|---|
| toner 1 | toner particle 1 | 2.00 | — | — | 100 | 100 | apparatus of FIG. 6 | 1.0 W/g (1800 rpm) | 5 min |
| toner 2 | toner particle 2 | 2.00 | — | — | 100 | 100 | apparatus of FIG. 6 | 1.0 W/g (1800 rpm) | 5 min |
| toner 3 | toner particle 3 | 2.00 | — | — | 100 | 100 | apparatus of FIG. 6 | 1.0 W/g (1800 rpm) | 5 min |
| toner 4 | toner particle 4 | 2.00 | — | — | 100 | 100 | apparatus of FIG. 6 | 1.0 W/g (1800 rpm) | 5 min |
| toner 5 | toner particle 2 | 2.00 | — | — | 100 | 100 | apparatus of FIG. 6 | 1.0 W/g (1800 rpm) | 5 min |
| toner 6 | toner particle 2 | 2.00 | — | — | 100 | 100 | apparatus of FIG. 6 | 1.0 W/g (1800 rpm) | 5 min |
| toner 7 | toner particle 2 | 1.70 | 0.30 | — | 85 | 85 | apparatus of FIG. 6 | 1.0 W/g (1800 rpm) | 5 min |
| toner 8 | toner particle 2 | 1.70 | 0.15 | 0.15 | 85 | 85 | apparatus of FIG. 6 | 1.0 W/g (1800 rpm) | 5 min |
| toner 9 | toner particle 2 | 1.70 | 0.30 | — | 85 | 80 | apparatus of FIG. 6 | 1.0 W/g (1800 rpm) | 5 min |
| toner 10 | toner particle 2 | 1.70 | 0.30 | — | 85 | 90 | apparatus of FIG. 6 | 1.0 W/g (1800 rpm) | 5 min |
| toner 11 | toner particle 2 | 1.50 | — | — | 100 | 100 | apparatus of FIG. 6 | 1.0 W/g (1800 rpm) | 5 min |
| toner 12 | toner particle 2 | 1.28 | 0.22 | — | 85 | 85 | apparatus of FIG. 6 | 1.0 W/g (1800 rpm) | 5 min |
| toner 13 | toner particle 2 | 1.28 | 0.12 | 0.10 | 85 | 85 | apparatus of FIG. 6 | 1.0 W/g (1800 rpm) | 5 min |
| toner 14 | toner particle 2 | 2.60 | — | — | 100 | 100 | apparatus of FIG. 6 | 1.0 W/g (1800 rpm) | 5 min |
| toner 15 | toner particle 2 | 2.25 | 0.35 | — | 86 | 86 | apparatus of FIG. 6 | 1.0 W/g (1800 rpm) | 5 min |
| toner 16 | toner particle 2 | 2.25 | 0.20 | 0.15 | 86 | 86 | apparatus of FIG. 6 | 1.0 W/g (1800 rpm) | 5 min |
| toner 17 | toner particle 2 | 1.80 | — | — | 100 | 100 | apparatus of FIG. 6 | 1.0 W/g (1800 rpm) | 5 min |
| toner 18 | toner particle 2 | 1.80 | — | — | 100 | 100 | apparatus of FIG. 6 | 1.0 W/g (1800 rpm) | 5 min |
| toner 19 | toner particle 3 | 1.50 | — | — | 100 | 100 | apparatus of FIG. 6 | 1.6 W/g (2500 rpm) | 5 min |
| toner 20 | toner particle 4 | 1.50 | — | — | 100 | 100 | apparatus of FIG. 6 | 1.6 W/g (2500 rpm) | 5 min |
| toner 21 | toner particle 3 | 1.50 | — | — | 100 | 100 | apparatus of FIG. 6 | 0.6 W/g (1400 rpm) | 5 min |
| toner 22 | toner particle 4 | 1.50 | — | — | 100 | 100 | apparatus of FIG. 6 | 0.6 W/g (1400 rpm) | 5 min |
| toner 23 | toner particle 3 | 2.60 | — | — | 100 | 100 | apparatus of FIG. 6 | 1.6 W/g (2500 rpm) | 5 min |
| toner 24 | toner particle 4 | 2.60 | — | — | 100 | 100 | apparatus of FIG. 6 | 1.6 W/g (2500 rpm) | 5 min |
| toner 25 | toner particle 3 | 2.60 | — | — | 100 | 100 | apparatus of FIG. 6 | 0.6 W/g (1400 rpm) | 5 min |
| toner 26 | toner particle 4 | 2.60 | — | — | 100 | 100 | apparatus of FIG. 6 | 0.6 W/g (1400 rpm) | 5 min |
| toner 27 | toner particle 5 | 2.00 | — | — | 100 | 100 | apparatus of FIG. 6 | 1.0 W/g (1800 rpm) | 5 min |
| toner 28 | toner particle 6 | 2.00 | — | — | 100 | 100 | apparatus of FIG. 6 | 1.0 W/g (1800 rpm) | 5 min |
| toner 29 | toner particle 7 | 2.00 | — | — | 100 | 100 | apparatus of FIG. 6 | 1.0 W/g (1800 rpm) | 5 min |
| toner 30 | toner particle 8 | 2.00 | — | — | 100 | 100 | apparatus of FIG. 6 | 1.0 W/g (1800 rpm) | 5 min |
| toner 31 | toner particle 9 | 2.00 | — | — | 100 | 100 | apparatus of FIG. 6 | 1.0 W/g (1800 rpm) | 5 min |
| toner 32 | toner particle 10 | 2.00 | — | — | 100 | 100 | apparatus of FIG. 6 | 1.0 W/g (1800 rpm) | 5 min |
| toner 33 | toner particle 11 | 2.00 | — | — | 100 | 100 | apparatus of FIG. 6 | 1.0 W/g (1800 rpm) | 5 min |
| comparative toner 1 | toner particle 2 | 1.50 | — | — | 100 | 100 | Henschel mixer | 3000 rpm | 2 min |
| comparative toner 2 | toner particle 2 | 1.50 | — | — | 100 | 100 | Henschel mixer | 4000 rpm | 5 min |
| comparative toner 3 | toner particle 2 | 2.60 | — | — | 100 | 100 | Henschel mixer | 3000 rpm | 2 min |

TABLE 2-continued

| magnetic toner number | magnetic toner particle | inorganic fine particles (mass parts) silica fine particles | titania fine particles | alumina fine particles | content of the silica fine particles (mass %) | content of silica fine particles in the fixed inorganic fine particles (mass %) | external addition conditions external addition apparatus | mixing conditions | mixing time |
|---|---|---|---|---|---|---|---|---|---|
| comparative toner 4 | toner particle 2 | 2.60 | — | — | 100 | 100 | Henschel mixer | 4000 rpm | 5 min |
| comparative toner 5 | toner particle 2 | 1.50 | — | — | 100 | 100 | hybridizer | 7000 rpm | 8 min |
| comparative toner 6 | toner particle 2 | 1.50 | — | — | 100 | 100 | hybridizer | 7000 rpm | 8 min |
| comparative toner 7 | toner particle 2 | 2.00 | — | — | 100 | 100 | hybridizer | 6000 rpm | 5 min |
| comparative toner 8 | toner particle 2 | 2.00 | — | — | 100 | 100 | hybridizer | 7000 rpm | 8 min |
| comparative toner 9 | toner particle 14 | 1.00 | — | — | 100 | 100 | Henschel mixer | 4000 rpm | 2 min |
| comparative toner 10 | toner particle 15 | 2.00 | — | — | 100 | 100 | Henschel mixer | 4000 rpm | 2 min |
| comparative toner 11 | toner particle 14 | 1.00 | — | — | 100 | 100 | Henschel mixer | 4000 rpm | 2 min |
| comparative toner 12 | toner particle 15 | 2.00 | — | — | 100 | 100 | Henschel mixer | 4000 rpm | 2 min |
| comparative toner 13 | toner particle 2 | 1.60 | 0.40 | — | 80 | 80 | apparatus of FIG. 6 | 1.0 W/g (1800 rpm) | 5 min |
| comparative toner 14 | toner particle 2 | 1.60 | 0.20 | 0.20 | 80 | 80 | apparatus of FIG. 6 | 1.0 W/g (1800 rpm) | 5 min |
| comparative toner 15 | toner particle 2 | 1.50 | — | — | 100 | 100 | apparatus of FIG. 6 | no pre-mixing 0.6 W/g (1400 rpm) | 3 min |
| comparative toner 16 | toner particle 2 | 1.20 | — | — | 100 | 100 | apparatus of FIG. 6 | no pre-mixing 0.6 W/g (1400 rpm) | 3 min |
| comparative toner 17 | toner particle 2 | 3.00 | — | — | 100 | 100 | apparatus of FIG. 6 | no pre-mixing 1.6 W/g (2500 rpm) | 3 min |
| comparative toner 18 | toner particle 2 | 2.60 | — | — | 100 | 100 | apparatus of FIG. 6 | no pre-mixing 0.6 W/g (1400 rpm) | 3 min |
| comparative toner 19 | toner particle 2 | 1.50 | — | — | 100 | 100 | apparatus of FIG. 6 | no pre-mixing 2.2 W/g (3300 rpm) | 5 min |
| comparative toner 20 | toner particle 2 | 2.00 | — | — | 100 | 100 | apparatus of FIG. 6 | 1.0 W/g (1800 rpm) | 5 min |
| comparative toner 21 | toner particle 12 | 2.00 | — | — | 100 | 100 | apparatus of FIG. 6 | 1.0 W/g (1800 rpm) | 5 min |
| comparative toner 22 | toner particle 13 | 2.00 | — | — | 100 | 100 | apparatus of FIG 6 | 1.0 W/g (1800 rpm) | 5 min |
| comparative toner 23 | toner particle 12 | 1.50 | — | — | 100 | 100 | apparatus of FIG. 6 | 1.6 W/g (2500 rpm) | 5 min |
| comparative toner 24 | toner particle 13 | 1.50 | — | — | 100 | 100 | apparatus of FIG. 6 | 1.6 W/g (2500 rpm) | 5 min |
| comparative toner 25 | toner particle 12 | 1.50 | — | — | 100 | 100 | apparatus of FIG. 6 | 0.6 W/g (1400 rpm) | 5 min |
| comparative toner 26 | toner particle 13 | 1.50 | — | — | 100 | 100 | apparatus of FIG. 6 | 0.6 W/g (1400 rpm) | 5 min |
| comparative toner 27 | toner particle 12 | 2.60 | — | — | 100 | 100 | apparatus of FIG. 6 | 1.6 W/g (2500 rpm) | 5 min |
| comparative toner 28 | toner particle 13 | 2.60 | — | — | 100 | 100 | apparatus of FIG. 6 | 1.6 W/g (2500 rpm) | 5 min |
| comparative toner 29 | toner particle 12 | 2.60 | — | — | 100 | 100 | apparatus of FIG. 6 | 0.6 W/g (1400 rpm) | 5 min |
| comparative toner 30 | toner particle 13 | 2.60 | — | — | 100 | 100 | apparatus of FIG. 6 | 0.6 W/g (1400 rpm) | 5 min |

The "content of silica fine particles in the fixed inorganic fine particles (mass %)" in the tables refers to the content (mass %) of the silica fine particles in the inorganic fine particles that are fixed to the magnetic toner particle surface.

TABLE 3

| magnetic toner | magnetic toner particle | weight-average particle diameter (D4) (μm) | D4/D1 | compression ratio (%) | average circularity | σr/σs | coverage ratio A (%) | B/A | coefficient of variation on the coverage ratio A (%) |
|---|---|---|---|---|---|---|---|---|---|
| toner 1 | toner particle 1 | 8.3 | 1.24 | 40 | 946 | 0.07 | 55.0 | 0.69 | 6.6 |
| toner 2 | toner particle 2 | 8.4 | 1.25 | 40 | 0.946 | 0.09 | 55.1 | 0.69 | 6.5 |
| toner 3 | toner particle 3 | 8.1 | 1.24 | 39 | 0.935 | 0.09 | 54.9 | 0.69 | 6.7 |
| toner 4 | toner particle 4 | 7.6 | 1.25 | 41 | 0.955 | 0.09 | 55.6 | 0.67 | 6.8 |

TABLE 3-continued

| magnetic toner | magnetic toner particle | weight-average particle diameter (D4) (μm) | D4/D1 | compression ratio (%) | average circularity | σr/σs | coverage ratio A (%) | B/A | coefficient of variation on the coverage ratio A (%) |
|---|---|---|---|---|---|---|---|---|---|
| toner 5 | toner particle 2 | 8.4 | 1.25 | 41 | 0.946 | 0.09 | 58.2 | 0.72 | 6.2 |
| toner 6 | toner particle 2 | 8.4 | 1.25 | 39 | 0.946 | 0.09 | 50.3 | 0.63 | 9.2 |
| toner 7 | toner particle 2 | 8.4 | 1.25 | 40 | 0.946 | 0.09 | 54.7 | 0.68 | 6.6 |
| toner 8 | toner particle 2 | 8.4 | 1.25 | 40 | 0.946 | 0.09 | 55.3 | 0.69 | 6.7 |
| toner 9 | toner particle 2 | 8.4 | 1.25 | 40 | 0.946 | 0.09 | 54.1 | 0.67 | 6.5 |
| toner 10 | toner particle 2 | 8.4 | 1.25 | 40 | 0.946 | 0.09 | 55.1 | 0.69 | 6.6 |
| toner 11 | toner particle 2 | 8.4 | 1.25 | 39 | 0.946 | 0.09 | 45.5 | 0.72 | 6.7 |
| toner 12 | toner particle 2 | 8.4 | 1.25 | 39 | 0.946 | 0.09 | 45.6 | 0.72 | 6.8 |
| toner 13 | toner particle 2 | 8.4 | 1.25 | 39 | 0.946 | 0.09 | 45.4 | 0.71 | 6.8 |
| toner 14 | toner particle 2 | 8.4 | 1.25 | 42 | 0.946 | 0.09 | 68.4 | 0.67 | 6.4 |
| toner 15 | toner particle 2 | 8.4 | 1.25 | 42 | 0.946 | 0.09 | 68.8 | 0.69 | 6.6 |
| toner 16 | toner particle 2 | 8.4 | 1.25 | 42 | 0.946 | 0.09 | 67.8 | 0.68 | 6.5 |
| toner 17 | toner particle 2 | 8.4 | 1.25 | 40 | 0.946 | 0.09 | 50.3 | 0.68 | 6.5 |
| toner 18 | toner particle 2 | 8.4 | 1.25 | 39 | 0.946 | 0.09 | 46.9 | 0.64 | 9.8 |
| toner 19 | toner particle 3 | 8.1 | 1.24 | 38 | 0.935 | 0.09 | 45.2 | 0.85 | 6.6 |
| toner 20 | toner particle 4 | 7.6 | 1.25 | 42 | 0.955 | 0.09 | 46.0 | 0.83 | 6.5 |
| toner 21 | toner particle 3 | 8.1 | 1.24 | 38 | 0.935 | 0.09 | 45.9 | 0.52 | 7.1 |
| toner 22 | toner particle 4 | 7.6 | 1.25 | 42 | 0.955 | 0.09 | 46.0 | 0.50 | 6.9 |
| toner 23 | toner particle 3 | 8.1 | 1.24 | 38 | 0.935 | 0.09 | 69.1 | 0.84 | 6.1 |
| toner 24 | toner particle 4 | 7.6 | 1.25 | 42 | 0.955 | 0.09 | 68.8 | 0.83 | 6.5 |
| toner 25 | toner particle 3 | 8.1 | 1.24 | 38 | 0.935 | 0.09 | 69.0 | 0.52 | 6.6 |
| toner 26 | toner particle 4 | 7.6 | 1.25 | 42 | 0.955 | 0.09 | 68.9 | 0.53 | 6.7 |
| toner 27 | toner particle 5 | 7.8 | 1.25 | 40 | 0.945 | 0.11 | 55.1 | 0.68 | 6.7 |
| toner 28 | toner particle 6 | 7.9 | 1.30 | 40 | 0.946 | 0.11 | 54.9 | 0.70 | 6.5 |
| toner 29 | toner particle 7 | 7.6 | 1.31 | 39 | 0.944 | 0.11 | 54.7 | 0.69 | 6.4 |
| toner 30 | toner particle 8 | 8.3 | 1.32 | 38 | 0.935 | 0.11 | 55.2 | 0.69 | 6.6 |
| toner 31 | toner particle 9 | 8.1 | 1.32 | 40 | 0.955 | 0.11 | 55.0 | 0.70 | 6.5 |
| toner 32 | toner particle 10 | 7.8 | 1.33 | 38 | 0.932 | 0.11 | 54.6 | 0.69 | 6.2 |
| toner 33 | toner particle 11 | 8.0 | 1.32 | 40 | 0.957 | 0.11 | 55.1 | 0.70 | 6.4 |
| comparative toner 1 | toner particle 2 | 8.4 | 1.25 | 40 | 0.946 | 0.09 | 36.0 | 0.41 | 17.8 |
| comparative toner 2 | toner particle 2 | 8.4 | 1.25 | 40 | 0.946 | 0.09 | 38.1 | 0.42 | 18.1 |
| comparative toner 3 | toner particle 2 | 8.4 | 1.25 | 40 | 0.946 | 0.09 | 50.1 | 0.35 | 13.1 |
| comparative toner 4 | toner particle 2 | 8.4 | 1.25 | 40 | 0.946 | 0.09 | 52.3 | 0.36 | 12.0 |
| comparative toner 5 | toner particle 2 | 8.4 | 1.25 | 40 | 0.946 | 0.09 | 43.4 | 0.83 | 13.3 |
| comparative toner 6 | toner particle 2 | 8.4 | 1.25 | 40 | 0.946 | 0.09 | 44.6 | 0.85 | 12.6 |
| comparative toner 7 | toner particle 2 | 8.4 | 1.25 | 40 | 0.946 | 0.09 | 52.2 | 0.53 | 12.4 |
| comparative toner 8 | toner particle 2 | 8.4 | 1.25 | 40 | 0.946 | 0.09 | 53.3 | 0.71 | 11.2 |
| comparative toner 9 | toner particle 14 | 8.4 | 1.22 | 35 | 0.971 | 0.09 | 42.5 | 0.47 | 15.1 |
| comparative toner 10 | toner particle 15 | 8.4 | 1.22 | 34 | 0.970 | 0.09 | 55.2 | 0.48 | 14.7 |
| comparative toner 11 | toner particle 14 | 8.4 | 1.22 | 35 | 0.971 | 0.09 | 63.0 | 0.88 | 13.1 |
| comparative toner 12 | toner particle 15 | 8.4 | 1.22 | 34 | 0.970 | 0.09 | 71.4 | 0.82 | 12.9 |
| comparative toner 13 | toner particle 2 | 8.4 | 1.25 | 40 | 0.946 | 0.09 | 54.0 | 0.68 | 7.9 |
| comparative toner 14 | toner particle 2 | 8.4 | 1.25 | 40 | 0.946 | 0.09 | 53.3 | 0.65 | 8.8 |
| comparative toner 15 | toner particle 2 | 8.4 | 1.25 | 40 | 0.946 | 0.09 | 46.1 | 0.47 | 12.3 |
| comparative toner 16 | toner particle 2 | 8.4 | 1.25 | 40 | 0.946 | 0.09 | 43.0 | 0.53 | 13.4 |
| comparative toner 17 | toner particle 2 | 8.4 | 1.25 | 40 | 0.946 | 0.09 | 72.2 | 0.53 | 12.1 |
| comparative toner 18 | toner particle 2 | 8.4 | 1.25 | 40 | 0.946 | 0.09 | 68.1 | 0.47 | 11.9 |
| comparative toner 19 | toner particle 2 | 8.4 | 1.25 | 40 | 0.946 | 0.09 | 46.9 | 0.88 | 12.5 |
| comparative toner 20 | toner particle 2 | 8.4 | 1.25 | 40 | 0.946 | 0.09 | 35.8 | 0.48 | 10.2 |
| comparative toner 21 | toner particle 12 | 7.6 | 1.30 | 36 | 0.935 | 0.09 | 55.1 | 0.70 | 6.6 |
| comparative toner 22 | toner particle 13 | 8.0 | 1.18 | 44 | 0.955 | 0.09 | 55.5 | 0.69 | 6.5 |
| comparative toner 23 | toner particle 12 | 7.6 | 1.30 | 36 | 0.935 | 0.09 | 45.9 | 0.84 | 6.5 |
| comparative toner 24 | toner particle 13 | 8.0 | 1.18 | 44 | 0.955 | 0.09 | 46.2 | 0.83 | 6.2 |
| comparative toner 25 | toner particle 12 | 7.6 | 1.30 | 36 | 0.935 | 0.09 | 45.5 | 0.52 | 6.5 |
| comparative toner 26 | toner particle 13 | 8.0 | 1.18 | 44 | 0.955 | 0.09 | 46.0 | 0.52 | 6.6 |
| comparative toner 27 | toner particle 12 | 7.6 | 1.30 | 36 | 0.935 | 0.09 | 69.1 | 0.82 | 6.1 |
| comparative toner 28 | toner particle 13 | 8.0 | 1.18 | 44 | 0.955 | 0.09 | 68.5 | 0.84 | 6.9 |
| comparative toner 29 | toner particle 12 | 7.6 | 1.30 | 36 | 0.935 | 0.09 | 69.3 | 0.52 | 6.4 |
| comparative toner 30 | toner particle 13 | 8.0 | 1.18 | 44 | 0.955 | 0.09 | 69.0 | 0.51 | 6.6 |

Example 1

(The Image-Forming Apparatus)

The image-forming apparatus was an LBP-3100 (Canon, Inc.), which was equipped with a small-diameter toner-carrying member that had a diameter of 10 mm; its printing speed had been modified from 16 sheets/minute to 20 sheets/minute. In an image-forming apparatus equipped with a small-diameter toner-carrying member, the durability and ghosting can be rigorously evaluated by changing the printing speed to 20 sheets/minute to provide an environment in which differences between the amount of charge on the residual toner and supplied toner are prominently displayed.

Using this modified apparatus and magnetic toner 1, initial evaluations were performed in a normal temperature, normal humidity environment (23.0° C./50% RH). After this, a test was performed in a normal temperature, normal humidity environment (23.0° C./50% RH) by making 1500 prints in one-sheet intermittent mode of a horizontal line image having a print percentage of 2%, followed by the post-durability testing evaluations.

According to the results, before and after the durability test a ghost-free, high-density image was obtained that presented little fogging in the nonimage areas. The results of the evaluations are shown in Table 4.

The evaluation methods and associated scales used in the evaluations carried out in the examples and comparative examples are described below.

<Image Density>

For the image density, a solid image area was formed and the density of this solid image was measured with a MacBeth reflection densitometer (MacBeth Corporation).

<Fogging>

A white image was output and its reflectance was measured using a REFLECTMETER MODEL TC-6DS from Tokyo Denshoku Co., Ltd. On the other hand, the reflectance was also similarly measured on the transfer paper (standard paper) prior to formation of the white image. A green filter was used as the filter. The fogging was calculated using the following formula from the reflectance before output of the white image and the reflectance after output of the white image.

fogging (reflectance)(%)=reflectance(%) of the standard paper−reflectance(%) of the white image sample The scale for evaluating the fogging is below.

A: very good (less than 1.5%)

B: good (less than 2.5% and greater than or equal to 1.5%)

C: average (less than 4.0% and greater than or equal to 2.5%)

D: poor (greater than or equal to 4.0%)

<Ghosting>

A plurality of 10 mm×10 mm solid images were produced in the top half of the image and a 2 dot×3 space halftone image was produced in the bottom half of the image, and the degree to which traces of the solid image were produced in the halftone image was determined by visual inspection.

A: very good (no ghosting)

B: good

C: image unproblematic from a practical standpoint

D: the level of ghosting is poor; image undesirable from a practical standpoint

Examples 2 to 33

Image output testing was performed as in Example 1, but using magnetic toners 2 to 33. According to the results, all of the magnetic toners provided images at at least practically unproblematic levels in the initial evaluations and in the post-durability testing evaluations. The results of the evaluations are shown in Table 4.

Comparative Examples 1 to 30

Image output testing was performed as in Example 1, but using comparative magnetic toners 1 to 30. According to the results, all of the magnetic toners gave a poor ghosting level in the post-durability testing evaluation. The results of the evaluations are shown in Table 4.

TABLE 4

| | | initial evaluations | | | post-durability testing evaluations | | |
|---|---|---|---|---|---|---|---|
| | magnetic toner | image density | fogging | ghosting | image density | fogging | ghosting |
| Example 1 | toner 1 | 1.55 | A (0.2) | A | 1.54 | A(0.4) | A |
| Example 2 | toner 2 | 1.50 | A (0.4) | A | 1.49 | A (0.6) | A |
| Example 3 | toner 3 | 1.51 | A (0.5) | A | 1.48 | A (0.7) | A |
| Example 4 | toner 4 | 1.49 | A (0.4) | A | 1.48 | A (0.7) | A |
| Example 5 | toner 5 | 1.52 | A (0.3) | A | 1.49 | A (0.5) | A |
| Example 6 | toner 6 | 1.48 | A (0.5) | A | 1.47 | A (0.5) | A |
| Example 7 | toner 7 | 1.44 | A (0.6) | A | 1.42 | A (0.8) | A |
| Example 8 | toner 8 | 1.44 | A (0.7) | A | 1.41 | A (0.9) | A |
| Example 9 | toner 9 | 1.43 | A(0.6) | A | 1.41 | A(0.6) | A |
| Example 10 | toner 10 | 1.48 | A (0.5) | A | 1.46 | A (0.7) | A |
| Example 11 | toner 11 | 1.45 | A (0.6) | A | 1.42 | A (1.0) | A |
| Example 12 | toner 12 | 1.41 | A (0.6) | A | 1.39 | A (1.2) | A |
| Example 13 | toner 13 | 1.42 | A (0.4) | A | 1.39 | A (1.1) | A |
| Example 14 | toner 14 | 1.51 | A (0.7) | A | 1.49 | A (0.9) | A |
| Example 15 | toner 15 | 1.44 | A (0.6) | A | 1.43 | A (0.8) | A |
| Example 16 | toner 16 | 1.44 | A (0.5) | A | 1.42 | A (0.6) | A |
| Example 17 | toner 17 | 1.50 | A (0.5) | A | 1.48 | A (0.8) | A |
| Example 18 | toner 18 | 1.47 | A (0.6) | A | 1.46 | A (0.7) | A |
| Example 19 | toner 19 | 1.44 | A (0.6) | A | 1.41 | A (1.0) | A |
| Example 20 | toner 20 | 1.44 | A (0.6) | A | 1.42 | A (1.0) | A |
| Example 21 | toner 21 | 1.45 | A (0.7) | A | 1.43 | A (1.1) | A |
| Example 22 | toner 22 | 1.44 | A (0.6) | A | 1.42 | A (1.0) | A |
| Example 23 | toner 23 | 1.47 | A (0.7) | A | 1.45 | A (0.8) | A |
| Example 24 | toner 24 | 1.47 | A (0.5) | A | 1.46 | A (0.7) | A |
| Example 25 | toner 25 | 1.48 | A (0.5) | A | 1.45 | A (0.8) | A |
| Example 26 | toner 26 | 1.47 | A (0.6) | A | 1.46 | A (0.8) | A |
| Example 27 | toner 27 | 1.44 | A (0.9) | A | 1.42 | A (1.2) | B |
| Example 28 | toner 28 | 1.42 | A (1.0) | A | 1.38 | B (1.5) | B |
| Example 29 | toner 29 | 1.39 | A (1.4) | B | 1.36 | B (1.7) | B |
| Example 30 | toner 30 | 1.38 | A (1.3) | B | 1.35 | B (1.8) | B |
| Example 31 | toner 31 | 1.38 | A (1.4) | B | 1.35 | B (1.7) | B |
| Example 32 | toner 32 | 1.35 | B (1.7) | B | 1.32 | B (2.2) | C |
| Example 33 | toner 33 | 1.34 | B (1.8) | B | 1.31 | B (2.3) | C |
| Comparative Example 1 | comparative toner 1 | 1.33 | B (2.2) | D | 1.30 | C (2.6) | D |
| Comparative Example 2 | comparative toner 2 | 1.35 | B (2.0) | C | 1.32 | C (2.5) | D |
| Comparative Example 3 | comparative toner 3 | 1.30 | C (2.5) | D | 1.27 | C (2.8) | D |
| Comparative Example 4 | comparative toner 4 | 1.32 | B (2.4) | C | 1.30 | C (2.6) | D |
| Comparative Example 5 | comparative toner 5 | 1.36 | B (2.2) | C | 1.31 | C (2.7) | D |
| Comparative Example 6 | comparative toner 6 | 1.37 | B (2.1) | C | 1.30 | C (2.5) | D |
| Comparative Example 7 | comparative toner 7 | 1.35 | C (2.5) | D | 1.31 | C (2.8) | D |

TABLE 4-continued

| | magnetic toner | initial evaluations | | | post-durability testing evaluations | | |
|---|---|---|---|---|---|---|---|
| | | image density | fogging | ghosting | image density | fogging | ghosting |
| Comparative Example 8 | comparative toner 8 | 1.37 | C (2.5) | C | 1.29 | C (2.9) | D |
| Comparative Example 9 | comparative toner 9 | 1.44 | B (2.1) | D | 1.39 | B (2.3) | D |
| Comparative Example 10 | comparative toner 10 | 1.41 | B (2.0) | D | 1.37 | B (2.2) | D |
| Comparative Example 11 | comparative toner 11 | 1.42 | B (2.0) | D | 1.39 | B (2.3) | D |
| Comparative Example 12 | comparative toner 12 | 1.44 | B (2.2) | D | 1.38 | B (2.4) | D |
| Comparative Example 13 | comparative toner 13 | 1.41 | A (1.3) | C | 1.37 | B (2.2) | D |
| Comparative Example 14 | comparative toner 14 | 1.42 | A (1.4) | C | 1.35 | B (2.1) | D |
| Comparative Example 15 | comparative toner 15 | 1.41 | A (1.2) | B | 1.38 | B (1.7) | D |
| Comparative Example 16 | comparative toner 16 | 1.43 | A (1.1) | B | 1.39 | B (1.6) | D |
| Comparative Example 17 | comparative toner 17 | 1.43 | A (1.2) | B | 1.38 | B (1.7) | D |
| Comparative Example 18 | comparative toner 18 | 1.42 | A (1.3) | B | 1.37 | B (1.7) | D |
| Comparative Example 19 | comparative toner 19 | 1.40 | A (1.1) | B | 1.37 | B (1.7) | D |
| Comparative Example 20 | comparative toner 20 | 1.34 | B (2.4) | C | 1.32 | C (2.7) | D |
| Comparative Example 21 | comparative toner 21 | 1.38 | B (1.8) | C | 1.35 | B (2.2) | D |
| Comparative Example 22 | comparative toner 22 | 1.40 | B (1.5) | C | 1.37 | B (1.9) | D |
| Comparative Example 23 | comparative toner 23 | 1.37 | B (1.6) | C | 1.35 | B (1.9) | D |
| Comparative Example 24 | comparative toner 24 | 1.39 | B (1.8) | C | 1.36 | B (2.0) | D |
| Comparative Example 25 | comparative toner 25 | 1.38 | B (1.7) | C | 1.36 | B (2.0) | D |
| Comparative Example 26 | comparative toner 26 | 1.39 | B (1.6) | C | 1.37 | B (1.8) | D |
| Comparative Example 27 | comparative toner 27 | 1.35 | B (2.0) | C | 1.34 | B (2.3) | D |
| Comparative Example 28 | comparative toner 28 | 1.36 | B (2.1) | C | 1.35 | B (2.4) | D |
| Comparative Example 29 | comparative toner 29 | 1.36 | B (1.9) | C | 1.35 | B (2.1) | D |
| Comparative Example 30 | comparative toner 30 | 1.34 | B (2.0) | C | 1.33 | B (2.3) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-286202, filed Dec. 27, 2011, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member
103: regulating blade
114: transfer member (transfer roller)
116: cleaner
117: charging member (charging roller)
121: laser generator (latent image-forming means, photoexposure apparatus)
123: laser
124: register roller
125: transport belt
126: fixing unit
140: developing device
141: stirring member

The invention claimed is:

1. A magnetic toner comprising magnetic toner particles comprising a binder resin and a magnetic body, and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed on the magnetic toner particles' surface, the magnetic toner has:

i) a coverage ratio A of at least 45.0% and not more than 70.0% and a coefficient of variation on the coverage ratio A of less than 10.0%, ii) a ratio [coverage ratio B/coverage ratio A] of the coverage ratio B to the coverage ratio A of from at least 0.50 to not more than 0.85, and iii) a compression ratio obtained by the following formula (1) of from at least 38% to not more than 42%:

$$\text{compression ratio (\%)} = \{1-(\text{bulk density}/\text{packed bulk density})\}\times 100. \quad \text{formula (1)}$$

2. The magnetic toner according to claim 1, wherein the average circularity of the magnetic toner is from at least 0.935 to not more than 0.955.

3. The magnetic toner according to claim 1, wherein the magnetic toner has a ratio [D4/D1] of the weight-average particle diameter (D4) to the number-average particle diameter (D1) of not more than 1.30.

4. The magnetic toner according to claim 1, wherein for a magnetic field of 79.6 kA/m, the magnetic toner has a ratio [σ/σ] of the residual magnetization (σr) to the intensity of magnetization (σs) of not more than 0.09.

* * * * *